US009004730B2

(12) United States Patent
LaVigna et al.

(10) Patent No.: US 9,004,730 B2
(45) Date of Patent: Apr. 14, 2015

(54) INTERLOCKING LIGHTING FIXTURE

(71) Applicant: 0Energy Lighting, Inc., Farmingdale, NY (US)

(72) Inventors: David LaVigna, Orlando, FL (US); Robert T. Temple, Orlando, FL (US)

(73) Assignee: 0Energy Lighting, Inc., Farmingdale, NY (US)

( * ) Notice: Subject to any disclaimer, the term of this patent is extended or adjusted under 35 U.S.C. 154(b) by 271 days.

(21) Appl. No.: 13/660,595

(22) Filed: Oct. 25, 2012

(65) Prior Publication Data

US 2013/0155688 A1 Jun. 20, 2013

Related U.S. Application Data

(60) Provisional application No. 61/551,505, filed on Oct. 26, 2011, provisional application No. 61/611,349, filed on Mar. 15, 2012.

(51) Int. Cl.

| | |
|---|---|
| ***F21S 8/00*** | (2006.01) |
| ***F21V 21/00*** | (2006.01) |
| ***F21S 2/00*** | (2006.01) |
| ***F21V 21/005*** | (2006.01) |
| ***F21V 21/30*** | (2006.01) |
| *F21V 5/04* | (2006.01) |
| *F21V 29/00* | (2006.01) |
| *F21V 29/02* | (2006.01) |
| *F21V 23/04* | (2006.01) |
| *F21W 131/40* | (2006.01) |
| *F21W 131/406* | (2006.01) |
| *F21Y 101/02* | (2006.01) |
| *F21Y 105/00* | (2006.01) |

(52) U.S. Cl.

CPC ..... *F21V 21/00* (2013.01); *F21S 2/005* (2013.01); *F21V 21/005* (2013.01); *F21V 21/30* (2013.01); *F21V 5/04* (2013.01); *F21V 29/004* (2013.01); *F21V 29/02* (2013.01); *F21V 23/04* (2013.01); *F21W 2131/40* (2013.01); *F21W 2131/406* (2013.01); *F21Y 2101/02* (2013.01); *F21Y 2105/001* (2013.01); *F21V 29/763* (2015.01)

(58) Field of Classification Search

CPC ..... F21V 21/30; F21W 2131/406
USPC ..... 362/426
See application file for complete search history.

(56) References Cited

U.S. PATENT DOCUMENTS 4,447,859 A * 5/1984 Raczynski ..... 362/13
4,918,576 A * 4/1990 Farrall et al. ..... 362/11

(Continued)

FOREIGN PATENT DOCUMENTS

WO WO 2010/128440 11/2010 ..... F21S 2/00

OTHER PUBLICATIONS

The Notification of Transmittal of the International Search Report and the Written Opinion of the International Search Authority, or the Declaration; the International Search Report; and the Written Opinion of the International Searching Authority (in English), dated Jan. 22, 2013, issued from Applicants' corresponding PCT Application No. PCT/EP2012/061888 by the International Searching Authority of WIPO.

*Primary Examiner* — Sean Gramling
(74) *Attorney, Agent, or Firm* — Gerald T. Bodner

(57) ABSTRACT

A lighting fixture includes a hexagonal housing having six side walls. Each side wall has a slot formed therein. Two or more lighting fixtures may be joined together to form a modular arrangement of lighting fixtures in a plurality of configurations by using an interlock piece which slides into channels formed in facing side walls of adjacent lighting fixtures to hold the lighting fixtures together.

22 Claims, 29 Drawing Sheets

(56) References Cited

U.S. PATENT DOCUMENTS

| | | | | |
|---|---|---|---|---|
| 6,851,831 | B2 * | 2/2005 | Karlicek, Jr. | 362/249.06 |
| 7,824,073 | B2 | 11/2010 | Hsieh et al. | 362/249.11 |
| D639,144 | S | 6/2011 | Schaefer et al. | D8/354 |
| 7,963,669 | B2 | 6/2011 | Hockel et al. | 362/249.02 |
| 2008/0037284 | A1 | 2/2008 | Rudisill | 362/629 |
| 2009/0010026 | A1 | 1/2009 | Gai | 362/609 |
| 2009/0097242 | A1 * | 4/2009 | Hsieh et al. | 362/234 |
| 2009/0154156 | A1 | 6/2009 | Lo et al. | 362/234 |
| 2011/0045704 | A1 | 2/2011 | Li et al. | 439/638 |

* cited by examiner

INTERLOCKING LIGHTING FIXTURE

CROSS-REFERENCE TO RELATED APPLICATIONS

This application is related to U.S. Provisional Application Ser. No. 61/551,505, filed on Oct. 26, 2011, and entitled "Interlocking Lighting Fixture", and U.S. Provisional Application Ser. No. 61/611,349, filed on Mar. 15, 2012, and also entitled "Interlocking Lighting Fixture", the disclosure of each of which is incorporated herein by reference and on which priority is hereby claimed.

BACKGROUND OF THE INVENTION

1. Field of the Invention

The present invention generally relates to lighting fixtures, and more specifically relates to lighting fixtures used for commercial, industrial and stage lighting.

2. Description of the Prior Art

Certain lighting fixtures used for commercial, industrial or stage lighting are generally stand-alone products which are individually suspended from a ceiling or mounted to a wall or floor. Each fixture must be individually directed or aimed to illuminate a desired object. Even if such conventional individual lighting fixtures are mounted on a common support, such as an elongated bar, the configurations in which such lighting fixtures may be arranged are limited.

OBJECTS AND SUMMARY OF THE INVENTION

It is an object of the present invention to provide a lighting fixture which may be arranged with other similarly structured lighting fixtures in a plurality of configurations.

It is another object of the present invention to provide a lighting fixture which has the capability of supporting other lighting fixtures attached thereto.

It is still another object of the present invention to provide a lighting fixture having a housing which is directly mountable to the housing of a similarly structured lighting fixture.

It is a further object of the present invention to provide a lighting fixture which has a polygonally-shaped housing, each side wall of the housing having the capability of interlocking with a side wall of a similarly polygonally-shaped lighting fixture to form a modular arrangement of lighting fixtures, where each fixture of the modular arrangement may be replaced, combined or interchanged easily with another lighting fixture.

It is yet a further object of the present invention to provide a modular arrangement of interlocking lighting fixtures in which the modular arrangement may be easily reconfigured as desired.

It is still a further object of the present invention to provide a lighting fixture having interlocking features which overcome the inherent disadvantages of conventional, non-interlocking lighting fixtures.

In one form of the present invention, a lighting fixture is constructed with a housing that has an overall polygonal shape, such as hexagonal, to define a plurality of generally planar side walls. The housing defines an interior space in which is mounted one or more light emitting devices, such as incandescent bulbs or light emitting diodes (LEDs), or plasma LEDs and plasma-based illumination systems, which may emit light at different wavelengths (e.g., blue, red or green), and electronic circuitry for controlling the illumination of the light emitting devices. Each side wall of the polygonally-shaped housing includes structure which allows it to be connected to the generally planar side wall of another similarly structured lighting fixture. An interlock piece may be used to join the two lighting fixtures together at their adjacent side walls. The interlock piece preferably is received by the cooperating structure situated on the facing side walls of adjacent lighting fixtures to join the two lighting fixtures together. Interlock pieces may also be used on other side walls of the lighting fixtures which have been joined together to add additional lighting fixtures and to thereby form a modular arrangement of lighting fixtures in a variety of configurations. The interlock piece or pieces may be removed to separate the lighting fixtures so that the lighting fixtures may be reconfigured in a different modular arrangement.

These and other objects, features and advantages of the present invention will be apparent from the following detailed description of illustrative embodiments thereof, which is to be read in connection with the accompanying drawings.

DETAILED DESCRIPTION OF THE PREFERRED EMBODIMENTS

Figure 1:
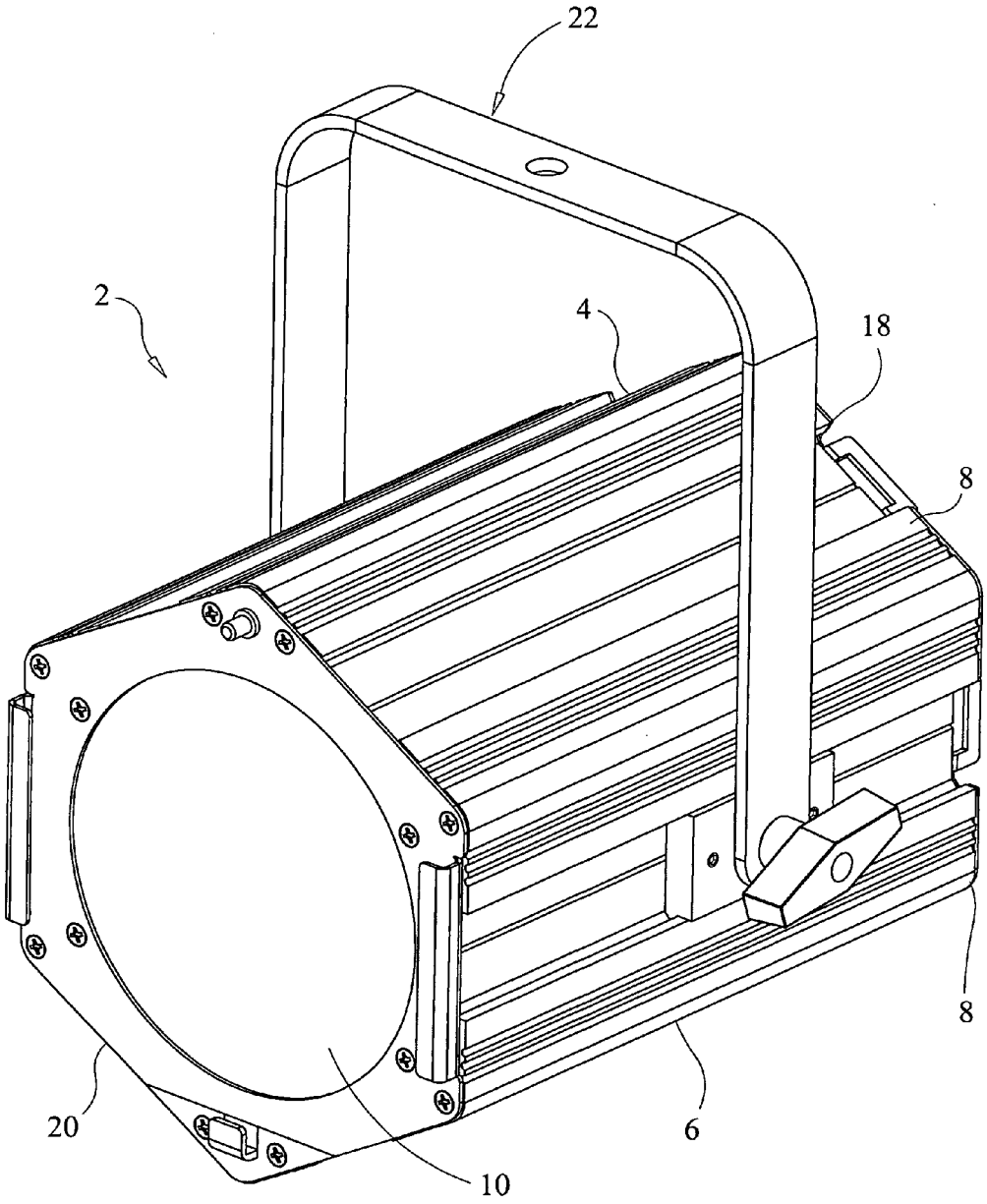
FIG. 1 is perspective view of a lighting fixture formed in accordance with the present invention.
Figure 2:
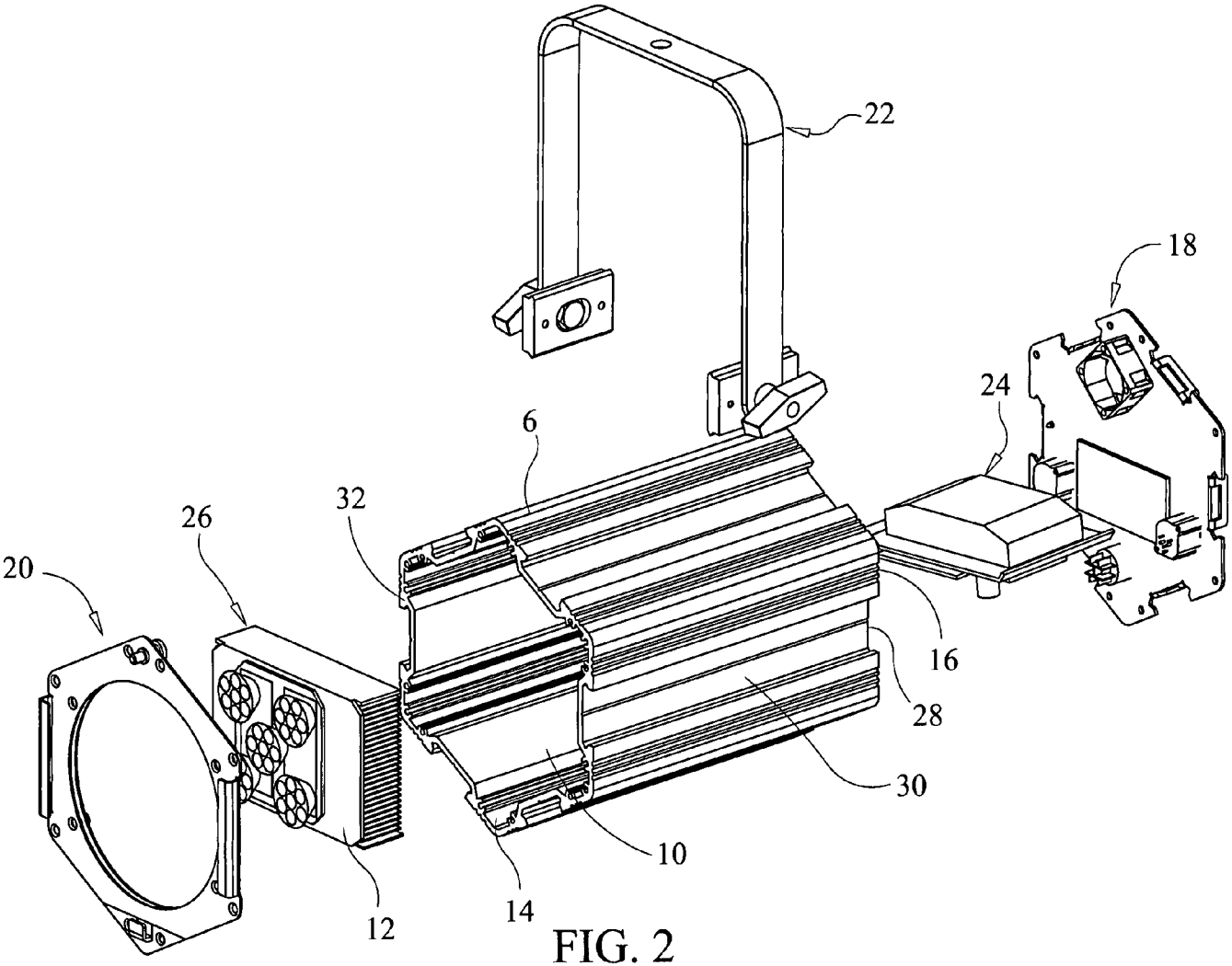
FIG. 2 is a partially exploded, perspective view of the lighting fixture of the present invention shown in FIG. 1.

Referring initially to FIGS. 1 and 2 of the drawings (reference may also be had to FIGS. 13-20), it will be seen that an interlocking lighting fixture 2 constructed in accordance with the present invention includes a housing 4 having a polygonally-shaped main body 6 that includes a plurality of interconnected, generally planar side walls 8 situated about the periphery thereof. The main body 6 of the housing 4 is preferably hexagonal in shape in transverse cross-section, but it is envisioned to be within the scope of the present invention to form the housing with any number of side walls 8, such as three or more, as long as the transverse width of each side wall is sufficient to accommodate its interconnection to a corresponding side wall of a similarly shaped lighting fixture 2.

The main body 6 of the housing defines an interior space or cavity 10 for receiving one or more light emitting devices 12 and electronic circuitry for controlling the illumination of the light emitting devices, as well as a cooling fan 13. The main body 6 of the housing 4 has an open front side 14 and an opposite open rear side 16.

The housing 4 of the lighting fixture 2 further includes a rear plate assembly 18, which is mounted on the open rear side 16 of the main body of the housing, and a front plate assembly 20, which is mounted on the open front side 14 of the main body 6 of the housing. As can be seen from FIG. 1, a hanger assembly 22 is mounted to the main body 6 of the housing and is provided for mounting the lighting fixture 2 from an overhead supporting structure so that it is in a suspended state, or to a supporting wall or floor.

An exploded view of several of the main components of the lighting fixture 2 of the present invention is shown in FIG. 2. Here, it is more clearly seen that the housing 4 includes the main body 6, defining an interior space or cavity 10 within which is received an electronics module 24, which contains the power supply circuit for driving the light emitting devices 12, and an assembly 26 containing the light emitting devices 12. Also, it may be seen from FIG. 2 how the rear plate assembly 18 is mounted on the open rear side 16 of the main body of the housing, and how the front plate assembly 20 is mounted on the open front side 14 of the main body of the housing, the light emitting devices 12 on their assembly being situated in proximity to the front plate assembly 20. Also, in FIG. 2, it will be seen how the hanger assembly 22 may be mounted to two diametrically opposite side walls 8 of the main body of the housing.

The polygonally-shaped main body 6 of the housing, which is shown in FIG. 2 as hexagonal in transverse cross-section in its preferred form, includes a plurality of side walls 8, as mentioned previously. Each side wall 8 has a recessed portion 28 formed in the outer surface thereof to define a channel or slot 30 that is preferably dovetailed in transverse cross-sectional shape. With this dovetailed shape of the channel or slot 30 thus being formed, two laterally opposite portions 32 of the side wall facing each other overhang the lateral edges of the recessed portion 28 and the channel or slot 30 defined thereby. The dovetailed channels or slots 30 formed in the side walls are provided for mounting the hanger assembly 22 to the main body 6 of the housing and, as will be seen, for interconnecting one lighting fixture 2 to another, similarly structured lighting fixture.

Figure 3:
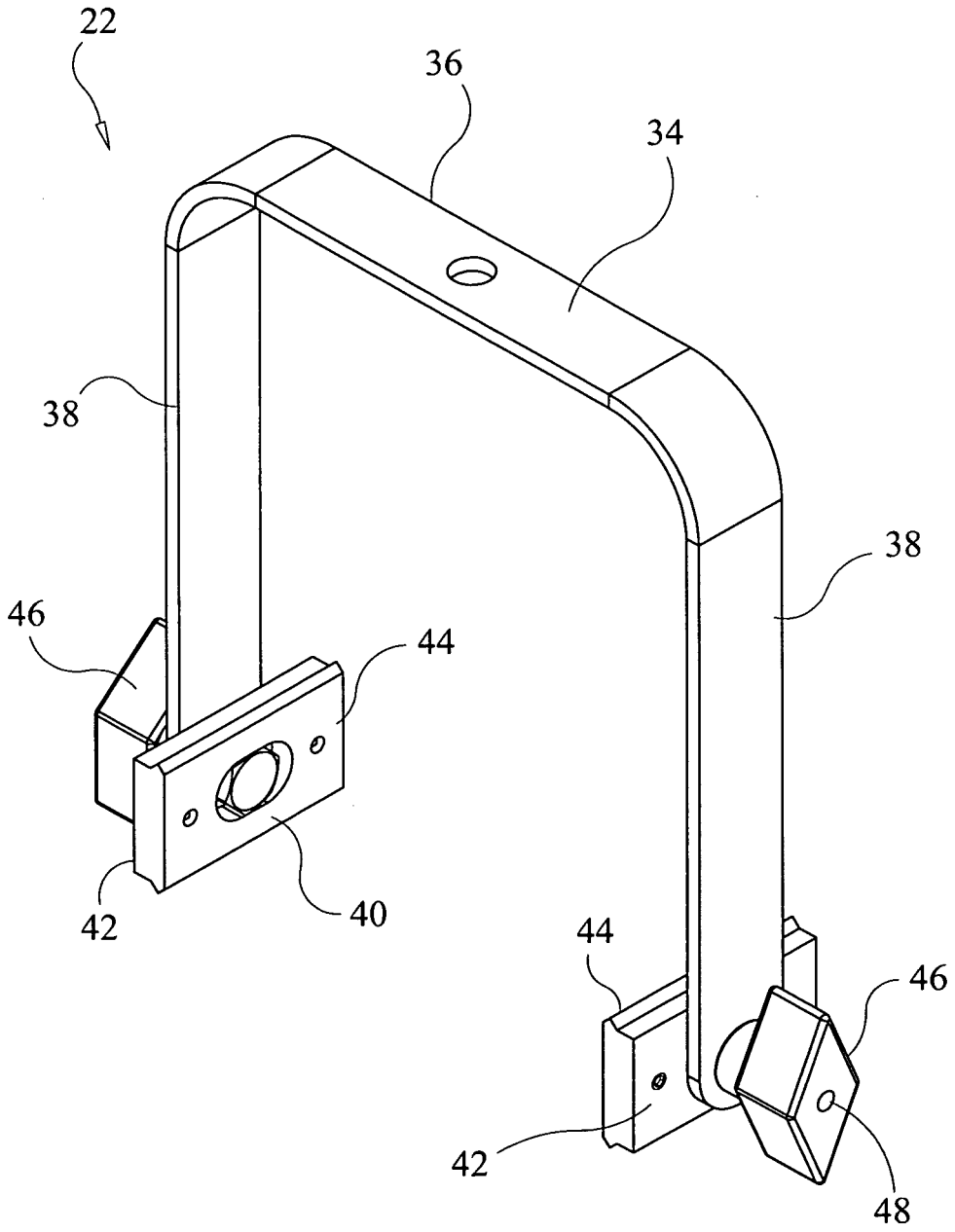
FIG. 3 is a perspective view of a hanger assembly forming part of the lighting fixture of the present invention.

Referring now to FIG. 3 of the drawings, a preferred form of the hanger assembly 22 is shown. The hanger assembly 22 preferably includes a hanger 34 formed as a U-shaped member, with a central cross leg 36 and two opposite side legs 38 extending downwardly and perpendicularly from the ends of the central cross leg. A hanger block 40 is mounted on the free end of each side leg 38 of the hanger. As can be seen from FIG. 3, each hanger block 40 has an outer segment 42 and an inner segment 44 situated axially opposite the outer segment, where the inner segment 44 has a greater width than that of the outer segment 42. The widths of the inner and outer segments 44, 42 are chosen so that the hanger block 40 may be captively received by, and reciprocatingly slideable within, a corresponding dovetailed-shaped channel or slot 30 formed in each of two side walls 8 of the main body of the housing situated diametrically opposite one another on the housing main body 6.

The hanger assembly 22 also includes a pair of hanger wing nuts or knobs 46, each wing nut or knob being affixed to a respective free end of a side leg 38 of the U-shaped hanger 34. A bolt 48 passes through an axial bore formed through the center of the wing nut or knob 46. This bolt 48 is threaded over a portion thereof, and is also received by a threaded bore formed through the thickness of the hanger block. By the user turning each hanger wing nut or knob 46, the free end of the bolt 48 pulls the inner segment 44 of the hanger block 40 tightly in engagement with the inner surfaces of the opposite portions 32 of the side wall which overhang the recessed portion 28 of the dovetailed channel or slot 30 so as to secure the hanger assembly 22 on the main body 6 of the housing of the lighting fixture 2 in a desired position along the length of the channel or slot 30 of the side walls on which the hanger assembly is mounted. Furthermore, as can be seen from FIG. 3, the U-shaped hanger 34 may be positioned at any desired angle with respect to the longitudinal axis of the main body 6 of the housing so that the lighting fixture 2 may be directed to illuminate an object at any desired angle.

Figure 4:
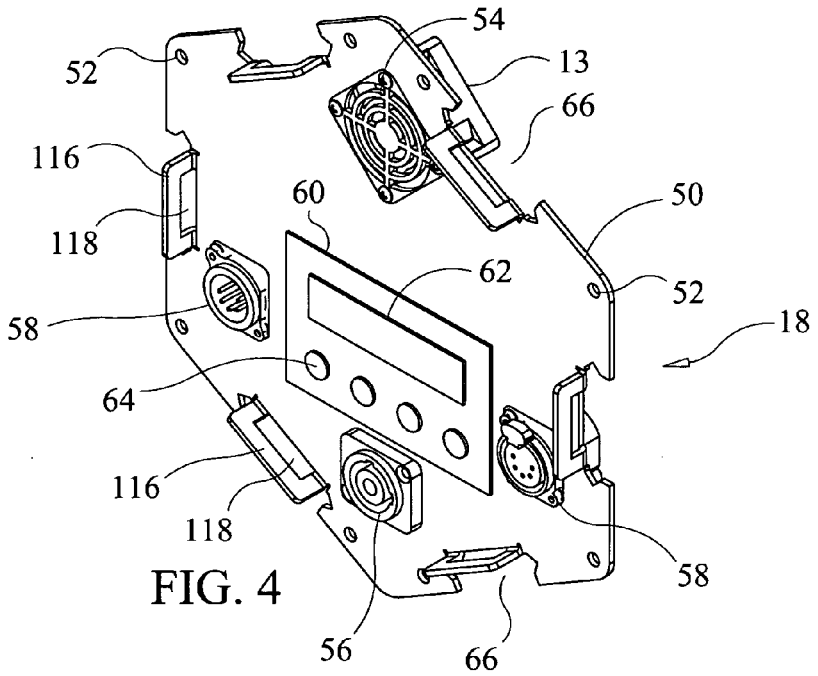
FIG. 4 is a perspective view of a rear plate assembly forming part of the lighting fixture of the present invention.

Referring now to FIG. 4 of the drawings, the rear plate assembly 18 is shown in greater detail. It can be seen from FIG. 4 that the rear plate assembly 18 includes a rear plate 50 that is generally planar in shape and has an outer periphery which conforms to the overall polygonal shape of the main body 6 of the housing 4. The rear plate assembly 18 is affixed to the open rear side 16 of the main body using fasteners, such as machine screws, which pass through spaced apart openings 52 formed through the thickness of the rear plate 50 of the assembly at peripheral locations on the plate, and are received by threaded openings formed axially in the rear edge of the main body 6 of the housing 4 at the open rear side 16 thereof.

The rear plate assembly 18 includes a generally planar plate 50, as mentioned previously, a fan cover or grill 54 mounted on the plate 50 and in communication with an opening formed through the thickness of the rear plate, the fan being preferably mounted in proximity to the fan cover or grill 54, a power connector 56, a control signal connector 58 and a control panel 60.

More specifically, a power connector 56 is mounted to the plate 50 of the rear plate assembly 18. The power connector 56 is preferably a male connector which mates with a corresponding female connector that is mounted on the end of a power electrical cord. The power connector 56 may be used to provide power to the electronic circuitry and light emitting devices 12 situated within the housing of the lighting fixture.

The control signal connector 58 is also mounted to the plate 50 of the rear plate assembly 18. The control signal connector 58 is preferably a male connector to which a corresponding female connector on the end of a control signal electrical cord is mateable to provide control signals to the electronic circuitry so that the illumination of the light emitting devices 12 within the lighting fixture 2 may be controlled remotely (i.e., externally of the lighting fixture) from a central lighting control unit.

As shown in FIG. 4, there is also preferably a control panel 60 that is mounted on the plate 50 of the rear plate assembly 18. This control panel 60 may include an LCD (liquid crystal display) 62 or other type of display, and a plurality of push button switches 64, so that the user of the lighting fixture 2 may input control signals directly from the control panel 60 to set up or program the lighting fixture to illuminate one or more of the light emitting devices 12.

The rear plate 50 is also formed with a plurality of dovetailed-shaped open slots 66 formed in the periphery of the rear plate. These dovetailed-shaped open slots 66 are spaced apart from each other along the periphery of the rear plate so that, when the rear plate assembly 18 is mounted on the open rear side 16 of the main body of the housing, they will be in alignment with the dovetailed channels 30 formed in the side walls 8 of the main body of the housing.

Figure 5:
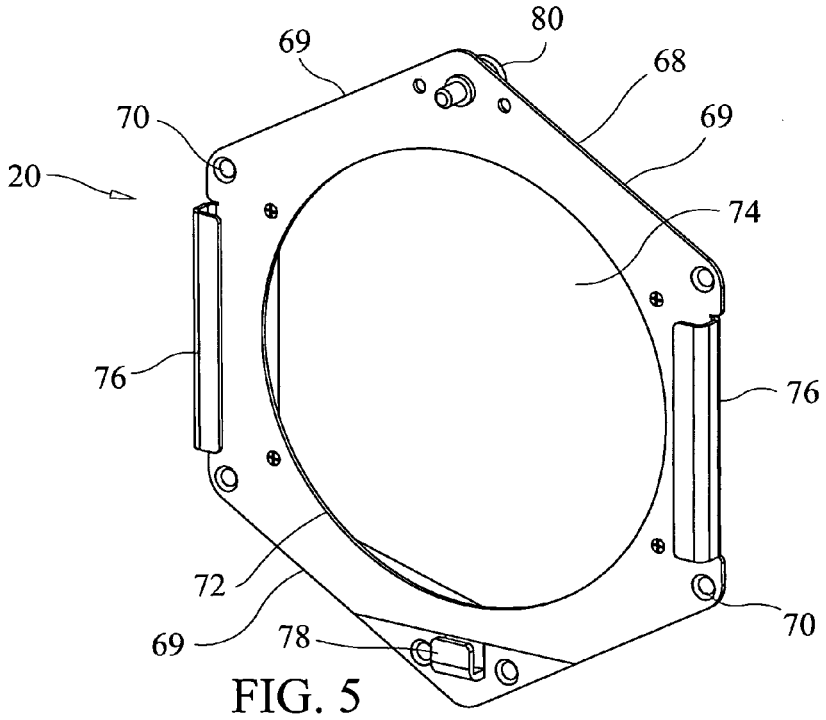
FIG. 5 is a perspective view of a front plate assembly forming part of the lighting fixture of the present invention.

FIG. 5 shows the front plate assembly 20 of the lighting fixture in greater detail. Like the rear plate assembly 18, the front plate assembly 20 includes a front plate 68 that is generally planar in shape and at its periphery it is polygonal to conform to the overall shape of the main body 6 of the housing 4. However, the front plate 68 does not include the dovetailed-shaped open slots as are formed in the rear plate 50 so that it has portions 69 situated in alignment with the channels or slots 30 formed in the side walls 8 of the main body 6 of the housing. These portions 69 (which may but preferably do not extend beyond the polygonal periphery of the front plate 68) act as stops for interlock pieces 92 received by the channels or slots 30 when two or more fixtures 2 are joined together, as will be described in greater detail. Also, like the rear plate assembly 18, the plate 68 of the front plate assembly 20 includes a series of spaced apart holes 70 formed through the thickness thereof near its periphery which are aligned with corresponding threaded holes formed axially in the front edge of the main body 6 of the housing at the open front side 14 thereof and which receive fasteners, such as machine screws, therethrough that are also received by the corresponding threaded holes of the main body to secure the front plate assembly 20 to the main body of the housing. As also shown in FIG. 5, the front plate 68 has a large central opening 72 formed through its thickness to allow light from the light emitting devices 12 to pass therethrough.

As can be more clearly seen in FIG. 5, removeably mounted on the exposed front side (or, alternatively, unexposed rear side) of the plate 68 of the front plate assembly 20 and in alignment with the central opening 72 in the plate is a diffuser or lens 74. The diffuser or lens 74, when mounted on the front side of the front plate 68, is held in place on the surface of the front plate 68 by a pair of elongated L-shaped brackets 76 mounted on and extending outwardly from the front (or rear) surface of the front plate and on diametrically opposite sides thereof. There is further provided a smaller, L-shaped center bracket 78 situated on the surface of the front plate 68 near the periphery thereof and between the diametrically opposed, elongated L-shaped brackets 76. The diffuser or lens 74 is dimensioned in size to be received between the diametrically opposed, elongated L-shaped brackets 76 on opposite lateral sides of the diffuser or lens and to be received by the smaller, L-shaped center bracket 78 on another side of the diffuser or lens. Also provided is a spring pin 80 which is biased by a spring (not shown) so that the free end or tip thereof extends outwardly from the same surface of the front plate 68 on which the L-shaped brackets 76, 78 are mounted and is situated diametrically opposite the L-shaped center bracket 78. A suitable alternative to the spring pin 80 is the resilient, raised clip 82 included on the fixtures 2 shown in FIGS. 11 and 12, which clip 82 would function in the same manner as the spring pin 80 shown in FIG. 5.

When mounting the diffuser or lens 74 to the front plate 68, the diffuser or lens pushes the spring pin 80 into the front plate so that its tip does not protrude outwardly from the surface of the front plate. The diffuser or lens 74 is then inserted between the elongated L-shaped brackets 76 until an edge of the diffuser or lens rests in the center L-shaped bracket 78, and the opposite edge of the diffuser or lens passes radially inwardly of the spring pin 80. Then, the spring pin 80 is released such that its tip protrudes outwardly from the surface of the front plate 68 on which the diffuser or lens 74 is mounted, thereby captively holding the diffuser or lens in place on the front plate. The diffuser or lens 74 may be easily removed from the front plate 68 by the user pushing in the tip of the spring pin 80 so that it is flush with the surface of the front plate and withdrawing the lens from between the elongated, L-shaped brackets 76 and over the depressed spring pin 80.

Figure 6:
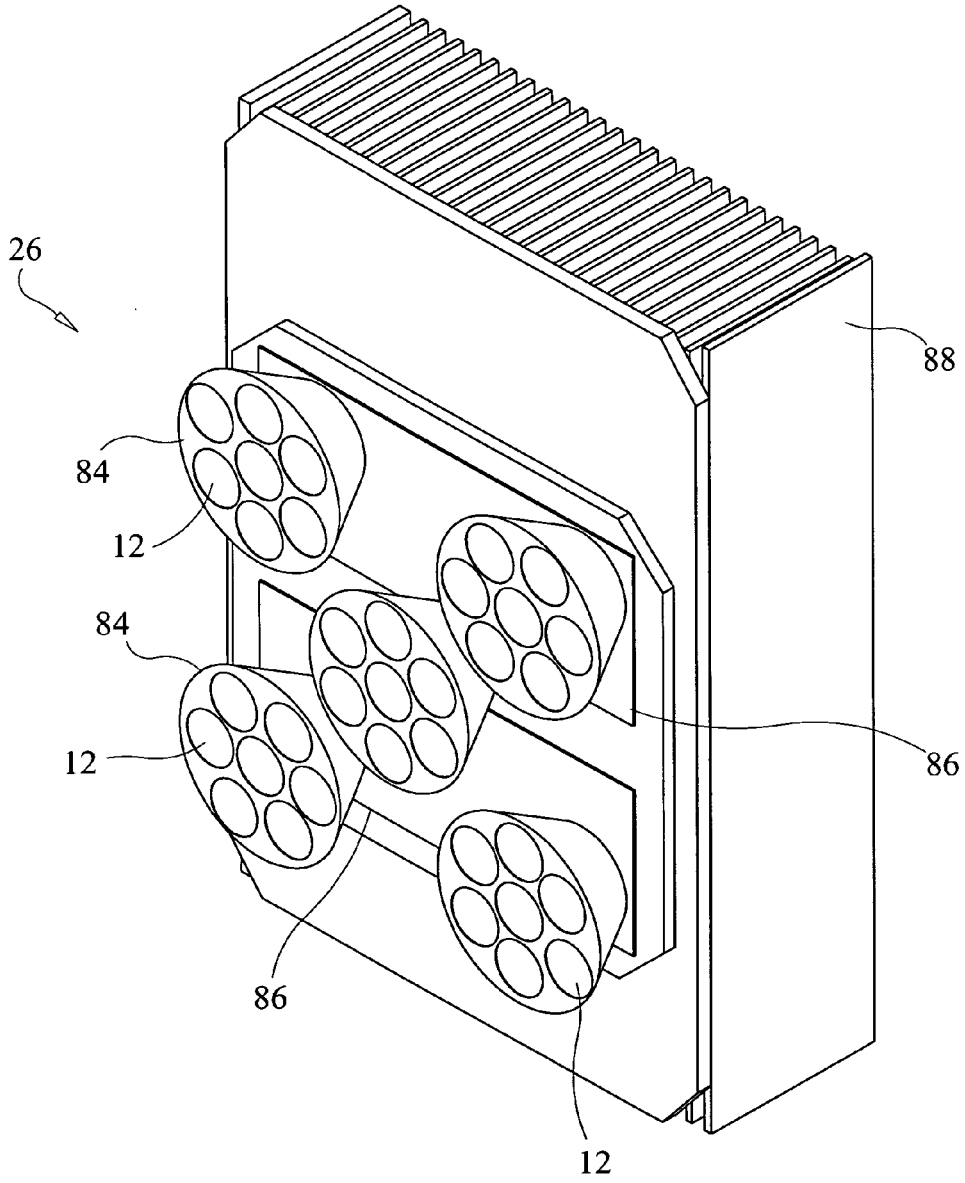
FIG. 6 is a perspective view of an assembly containing light emitting devices forming part of the lighting fixture of the present invention.

A preferred form of the assembly 26 containing the light emitting devices 12 is shown in FIG. 6. The light emitting devices 12 may be incandescent or halogen bulbs, or may take on other forms of lighting, but are preferably light emitting diodes (LEDs). The LEDs are preferably arranged as clusters 84 containing one or more LEDs (five clusters of seven LEDs are shown in FIG. 6). Each cluster 84 may contain LEDs of the same wavelength or of different wavelengths, to emit light of the same or different colors, for example, white, red, blue or green, when energized. The light emitting devices 12 are mounted on a printed circuit board 86 which, in turn, is mounted on or thermally coupled to a finned heatsink 88 to dissipate the heat generated by the light emitting devices 12. The assembly 26 which contains the light emitting devices is positioned within the interior space or cavity 10 of the main body 6 of the housing in proximity to the front plate assembly 20 and in alignment with the central opening 72 formed in the front plate 68 so that the light emitting devices 12 or LED clusters 84 mounted on the printed circuit board 86 face the diffuser or lens 74 of the front plate assembly.

Figure 7:
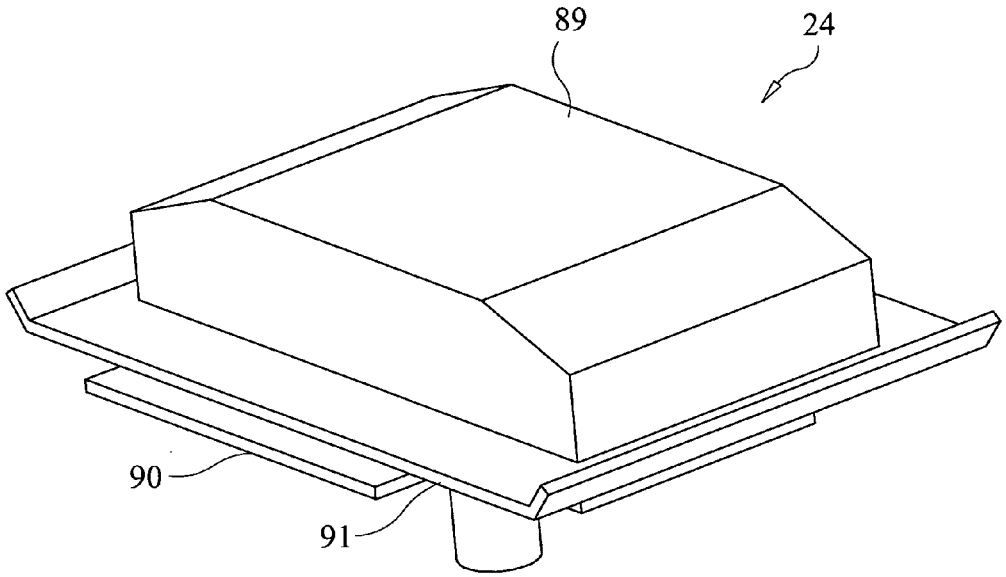
FIG. 7 is a perspective view of an electronics module forming part of the lighting fixture of the present invention.

FIG. 7 illustrates the electronics module 24. The electronics module 24 includes a power supply 89 for providing power to energize the light emitting devices 12 on the prior assembly 26 described. The power supply 89 is preferably connected to the power connector 56 mounted on the rear plate 50 of the fixture, and receives power over an external power cord connected thereto. The electronics module 24 is mounted on a driver printed circuit board 90, and further includes a mounting bracket 91 situated thereon for mounting the electronics module 24 within the interior space or cavity 10 of the main body of the housing, as described previously and shown in FIG. 2 of the drawings.

Figure 8:
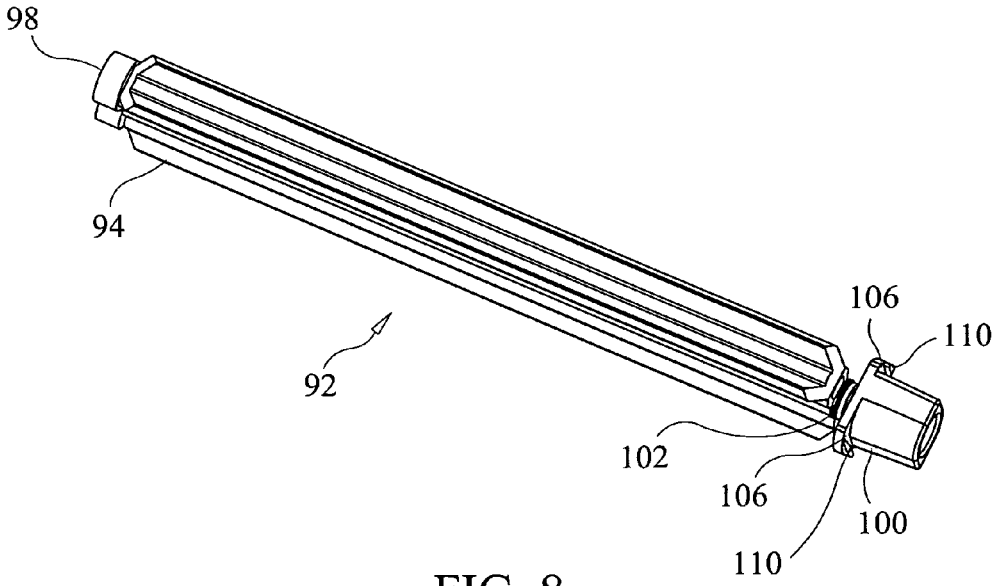
FIG. 8 is a perspective view of an interlock piece formed in accordance with the present invention and used to interconnect adjacent lighting fixtures of the present invention.
Figure 8A:
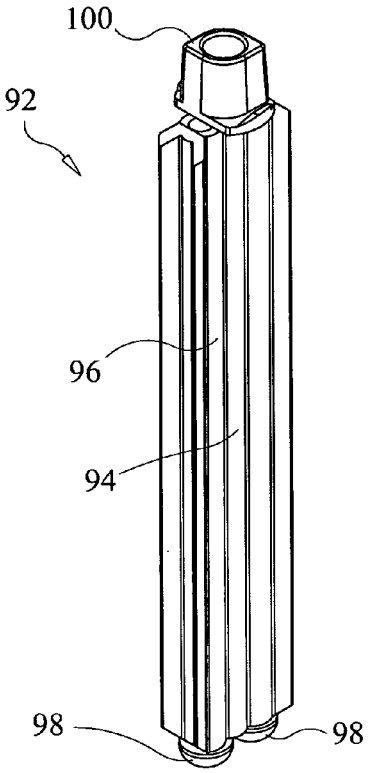
FIGS. 8*a* and 8*b* are perspective views of the interlock piece formed in accordance with the present invention and used to interconnect adjacent lighting fixtures of the present invention, and illustrating the interlock piece in a locked position (FIG. 8*a*) and an unlocked position (FIG. 8*b*).
Figure 8B:
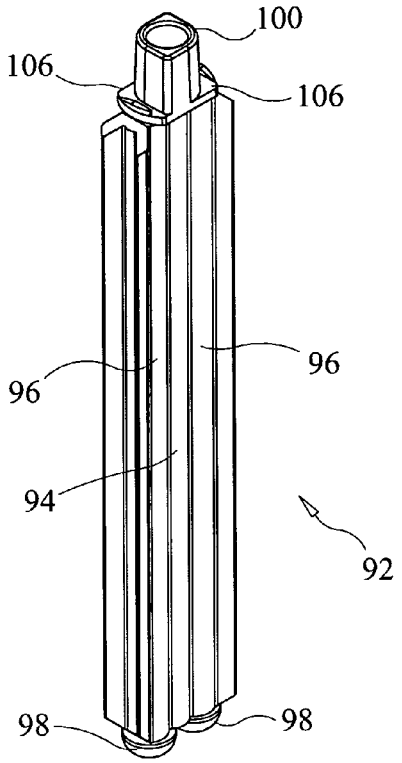
Figure 9:
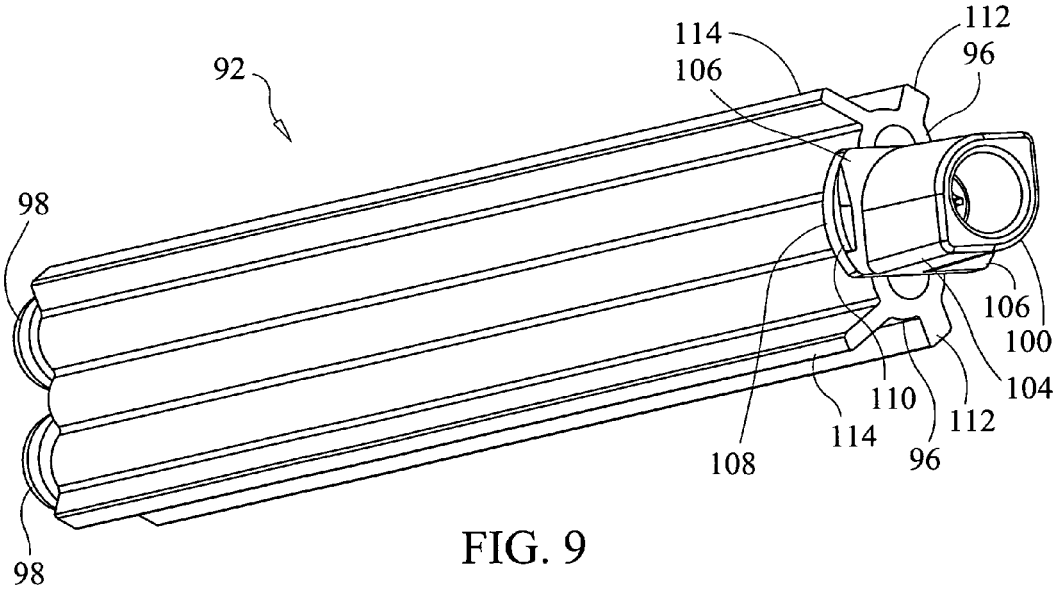
FIG. 9 is another perspective view of the interlock piece formed in accordance with the present invention and used to interconnect adjacent lighting fixtures of the present invention.
Figure 10:
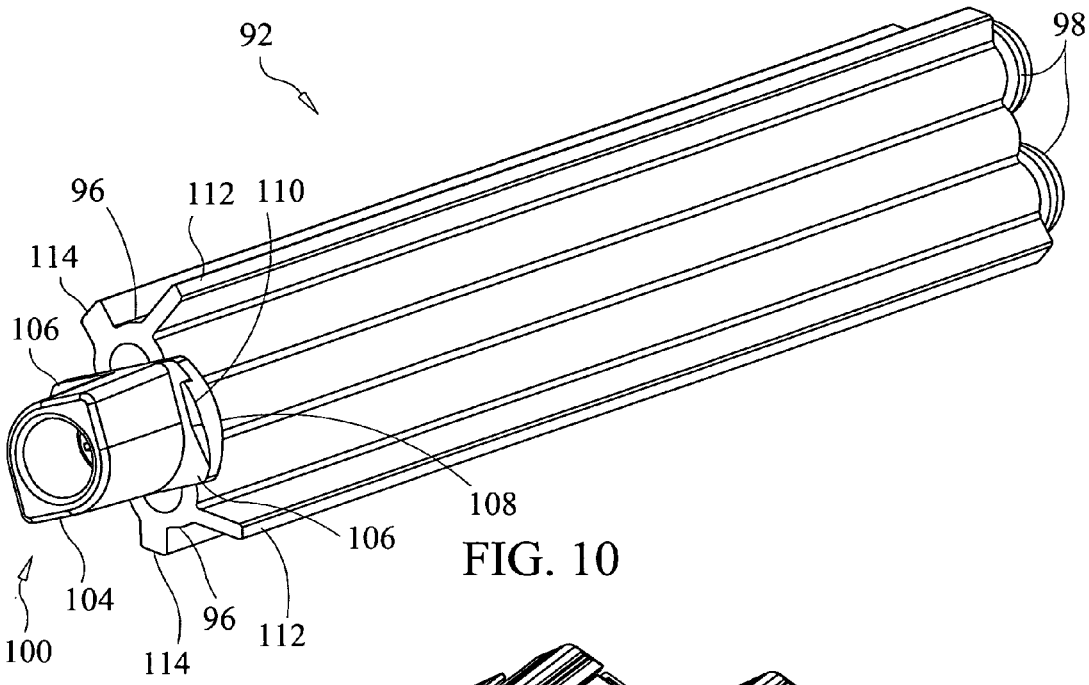
FIG. 10 is yet another perspective view of the interlock piece formed in accordance with the present invention and used to interconnect adjacent lighting fixtures of the present invention.

As also described previously, adjacent lighting fixtures 2 of the present invention may be interconnected to each other at side walls 8 of the main body 6 of their housings which face each other so that a modular arrangement of lighting fixtures 2 may be formed in a plurality of configurations. One way of joining adjacent lighting fixtures together is by using an interlock piece 92, such as shown in FIGS. 8-10 of the drawings. Reference may also be had to FIGS. 21-27 for additional views of lighting fixtures 2 that are joined together, as will be described. Note that certain features of the fixtures 2 have not been included in these drawings to facilitate an understanding of how the fixtures are joined together.

More specifically, the interlock piece 92 has a generally elongated member 94 formed from a pair of laterally conjoined tubular members 96, each tubular member 96 having a bumper or rubberized cushion 98 situated on one axially end thereof. A rotatable fastener or knob 100 is situated at an opposite axial end of the elongated member 94. The fastener or knob 100 is connected to the elongated member 94 of the interlock piece 92 with a friction bushing 102 interposed between the axial end face of the elongated member and the fastener, with the fastener 100 being rotatable on the axial end of the elongated member 94.

As shown in FIGS. 9 and 10, the fastener or knob 100 has a main body 104 which is generally elliptical in transverse cross-section over its axially outer portion to allow it to be more easily grasped and turned by a user. The fastener or knob 100 of the interlock piece 92 also includes on its main body 104 a pair of flanges 106 situated near its axially inner edge that is adjacent to the axial end of the elongated member 94 on which the fastener is connected. These flanges 106 protrude outwardly from the main body 104 of the fastener or knob 100 on diametrically opposite sides thereof. Each flange 106 includes an arcuate peripheral outer edge 108, and a raised lip 110 situated at this edge 108. As will be described, by turning the fastener or knob 100, these protruding flanges 106 will prevent the interlock piece 92 from being removed, or permit the interlock piece to be removed, from between two facing side walls 8 of adjacent lighting fixtures 2, depending upon the rotational position of the fastener or knob 100.

More specifically, and as shown in FIGS. 9 and 10 of the drawings, each interlock piece 92 (and there may be several interlock pieces used to join one lighting fixture to one or more adjacent lighting fixtures) includes a first pair or set of mutually diverging fins 112, 114 situated on a lateral side of the elongated member 94 of the interlock piece 92 and along the axial length of one tubular member 96, and a second pair or set of mutually diverging fins 112, 114 situated on an opposite lateral side of the elongated member 94 of the interlock piece 92 and along the axial length of the other tubular member 96. Thus, each of the first and second sets of fins includes a first angled fin 112 and a second angled fin 114, each fin 112, 114 preferably extending radially outwardly from the tubular member 96 on which it is formed.

In order to join two lighting fixtures 2 together, the fixtures are placed such that the planar side wall 8 of the main body of the housing of one fixture 2 is situated in close proximity to a planar side wall 8 of the main body of the housing of another fixture, with the side walls 8 of the fixtures 2 facing one another and the housings 4 situated in parallel. Then, the interlock piece 92 is fitted between the two facing side walls 8 of adjoining fixture housings 4 by sliding the elongated member 94 into the channels or slots 30 of the facing side walls 8.

Even more specifically, the first angled fins 112 of the first and second set of fins is received in the dovetailed channel or slot 30 of the side wall 8 of one lighting fixture 2, and the second angled fins 114 of the first and second set of fins is received in the dovetailed channel or slot 30 of the side wall 8 of the second lighting fixture 2. The interlock piece 92 is oriented such that the bumpers or cushions 98 situated at one axial end of the elongated member 94 of the interlock piece are directed toward the front plates 68 of the lighting fixtures and so that the fastener 100 is situated near the rear plates 50 of the lighting fixtures 2 to be joined. The interlock piece 92 is received by the dovetailed channels or slots 30 of the lighting fixtures from the open end of the channels or slots situated at the rear plate assembly 18 of each fixture, and is forced inwardly into the channels toward the front plates 68 of the adjacent lighting fixtures. The interlock piece 92 is slid through the dovetailed-shaped open slots 66 of the rear plate 50 and into the channels 30 of the side walls 8 of the lighting fixtures which face one another. More specifically, the first angled fins 112 of the first and second sets of fins are received under the overhanging portions 32 of a side wall 8 defining a respective dovetailed channel or slot 30 of one lighting fixture, and the second angled fins 114 of the first and second sets of fins are received under the overhanging portions 32 of the side wall 8 defining the respective channel or slot 30 of the other lighting fixture.

Because the front plate 68 of each lighting fixture 2 includes extended portions 69 which are in alignment with the channels or slots 30 of the main body 6 of the housing, a respective bumper or cushion 98 of the interlock piece 92 will engage the rear surface of the front plate 68 of each of the adjoining lighting fixtures 2 at these extended portions as the interlock piece is slid into the channels of the facing side walls of the housings. The overall axial length of the interlock piece 92, and in particular the elongated member 94 thereof, is chosen so that the fastener 100 of the interlock piece extends slightly beyond the open rear side 16 of the main body of the housing of each lighting fixture 2 now joined together by the interlock piece.

Returning again to FIGS. 2 and 4 of the drawings, it can be seen that the rear plate assembly 18 also includes U-shaped catches 116 extending outwardly from the rear surface of the rear plate 50. These catches 116 are spaced apart from each other, and each catch is situated in alignment with the recessed portion 28 of the dovetailed channel 30 of a respective side wall 8 of the main body of the housing when the rear plate assembly 18 is mounted on the main body of the housing. Each U-shaped catch 116 defines with the rear surface of the rear plate 50 a slot 118 for receiving a protruding flange 106 of the fastener 100 of the interlock piece, depending upon the orientation of the fastener.

When a user attaches two fixtures 2 together, he inserts the interlock piece 92 into the channels or slots 30 of two facing side walls 8 of the fixtures, and forces the interlock piece with slight pressure against the rear surface of the front plate 68 of the adjoining lighting fixtures 2 at the extended portions 69 such that the bumpers or rubberized cushions 98 are slightly compressed. Then, the fastener 100 of the interlock piece 92 is turned to cause the protruding flanges 106 and raised lips 110 on the flanges of the fastener to be at least partially received by the slot 118 of the U-shaped catches 116 situated in alignment therewith. Since the flanges 106 extend outwardly from opposite sides of the fastener 100, they will engage the U-shaped catches 116 and be received by their respective slots 118 of the two adjacent lighting fixtures 2. The slight compression of the bumpers 98 against the front plates 68 of the two lighting fixtures will bias and exert some pressure on the flanges 106 against the U-shaped catches 116 to minimize any rotation of the fastener 100 and to prevent the flanges from dislocating from the slots 118 of the U-shaped catches 116 of the adjacent lighting fixtures 2, thereby helping to secure the lighting fixtures together.

Of course, when joining two lighting fixtures together, the interlock piece 92 is used between two facing side walls 8 that are available for interconnection and which do not have the hanger assembly 22 mounted thereto.

As mentioned previously, the lighting fixture 2 of the present invention may be joined to other similarly shaped lighting fixtures to form a modular arrangement of lighting fixtures in a plurality of configurations. Some of these configurations are shown in FIGS. 11 and 12.

Figure 11:
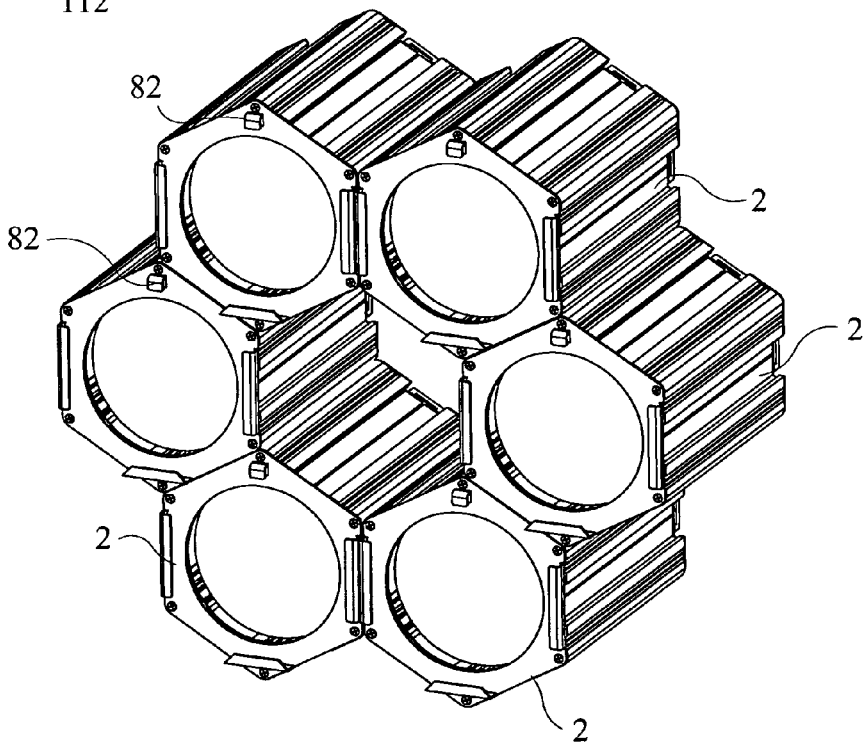
FIG. 11 is a perspective view of an exemplary arrangement of lighting fixtures formed in accordance with the present invention.

For example, and as shown in FIG. 11, a circular arrangement of six lighting fixtures 2 may be formed by joining adjacent side walls 8 of the lighting fixtures with interlock pieces 92. A single hanger assembly 22, having an extended central cross leg 36 to bridge two interconnected lighting fixtures 2 of the modular arrangement, may be affixed to the opposite, non-facing sides 8 of a pair of interconnected lighting fixtures 2 of the arrangement in order to suspend the arrangement from a ceiling or other support member, or multiple hanger assemblies may be used. In the example of the arrangement shown in FIG. 11, each lighting fixture 2 preferably has a hexagonally-shaped housing 4.

Figure 12:
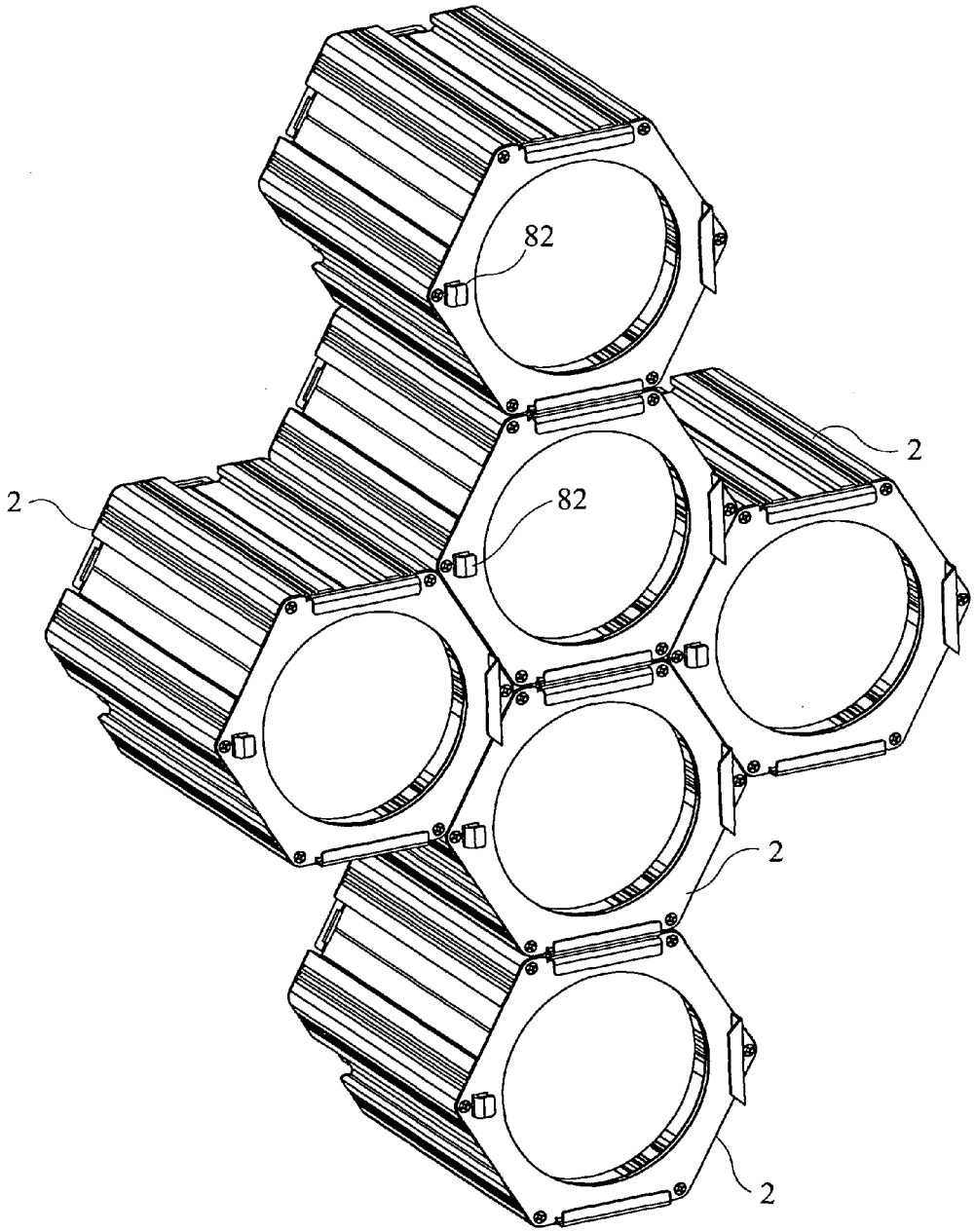
FIG. 12 is a perspective view of another exemplary arrangement of lighting fixtures formed in accordance with the present invention.
Figure 13:
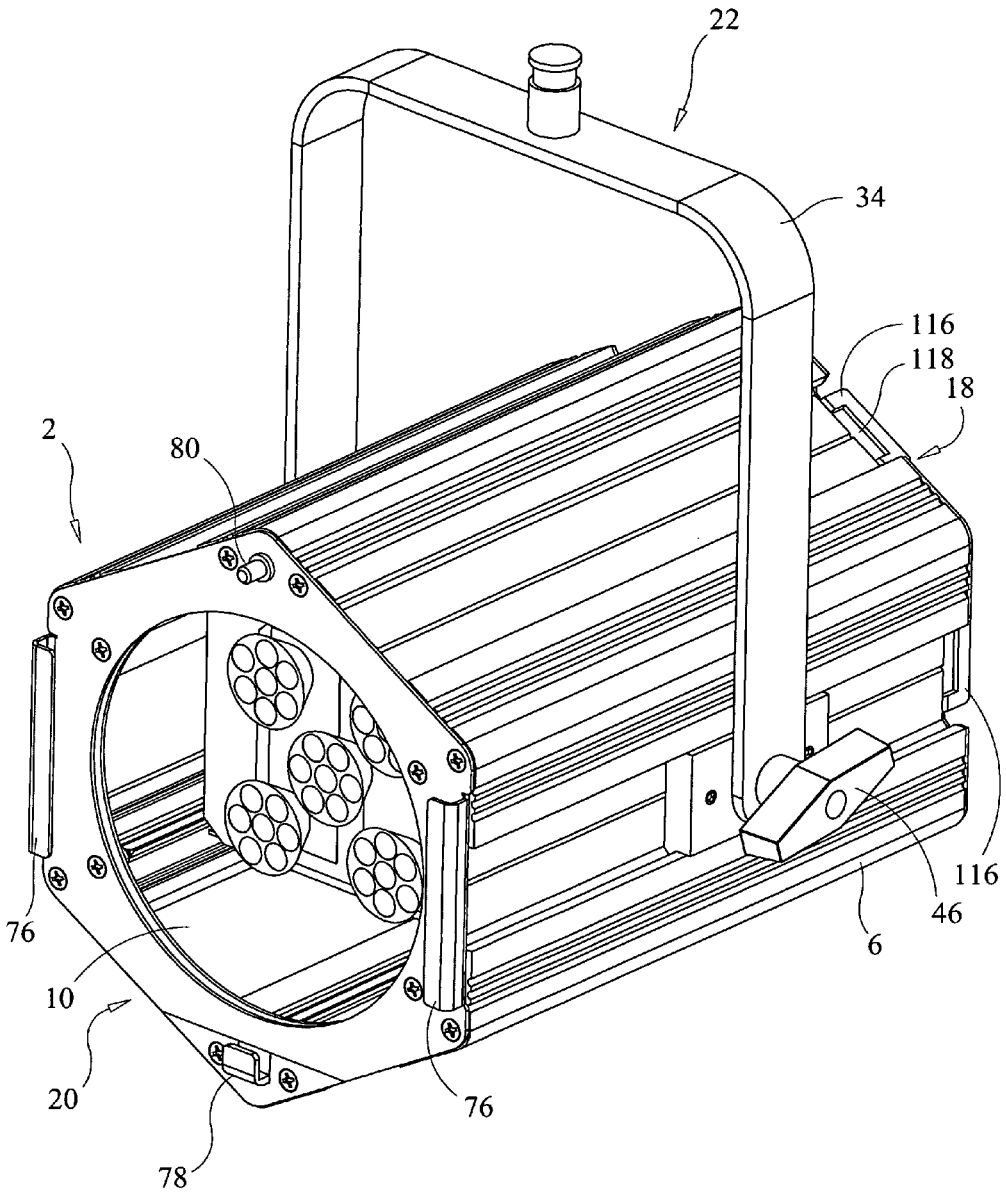
FIG. 13 is a front perspective view of the lighting fixture of the present invention, shown without a diffuser or lens mounted on the front side thereof.
Figure 14:
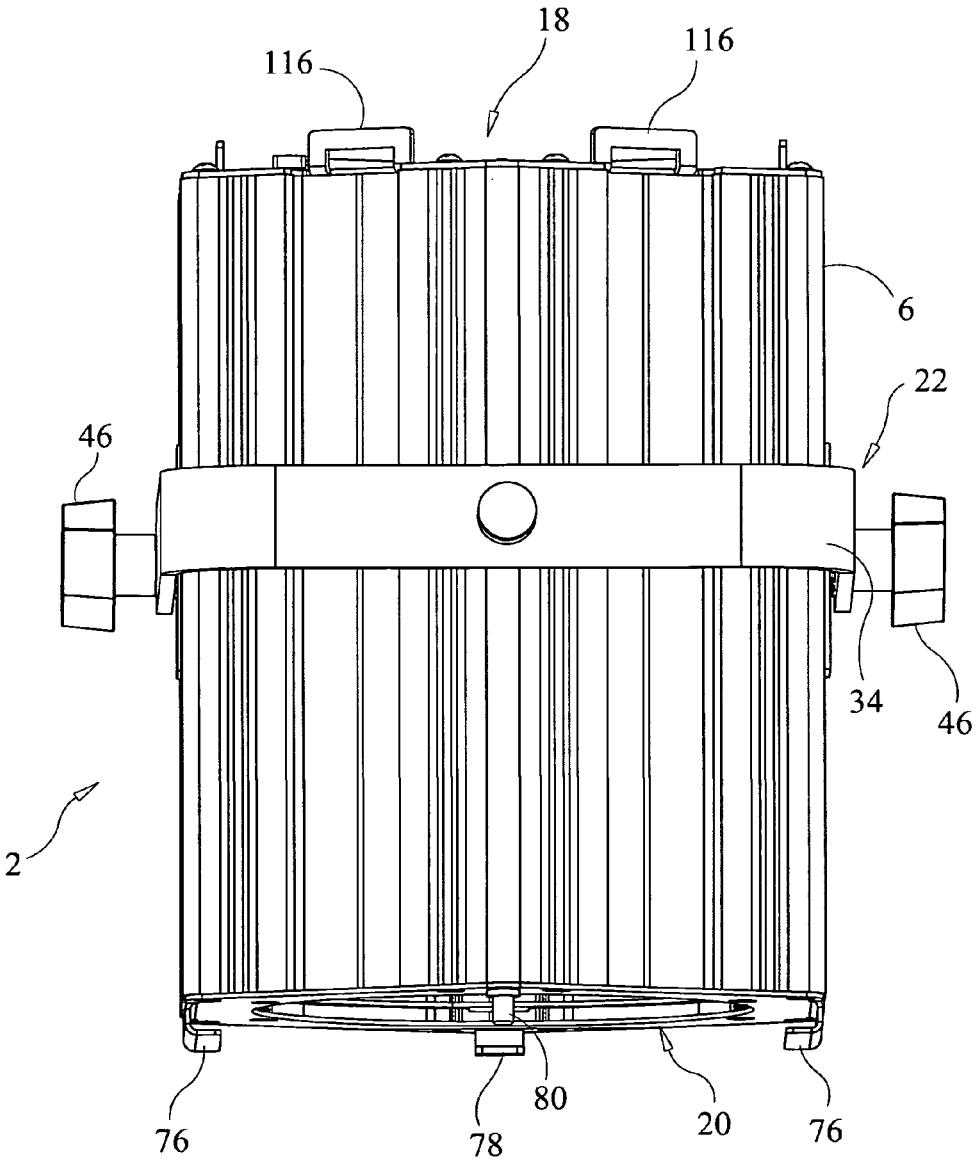
FIG. 14 is a top perspective view of the lighting fixture of the present invention, shown without a diffuser or lens mounted on the front side thereof.
Figure 15:
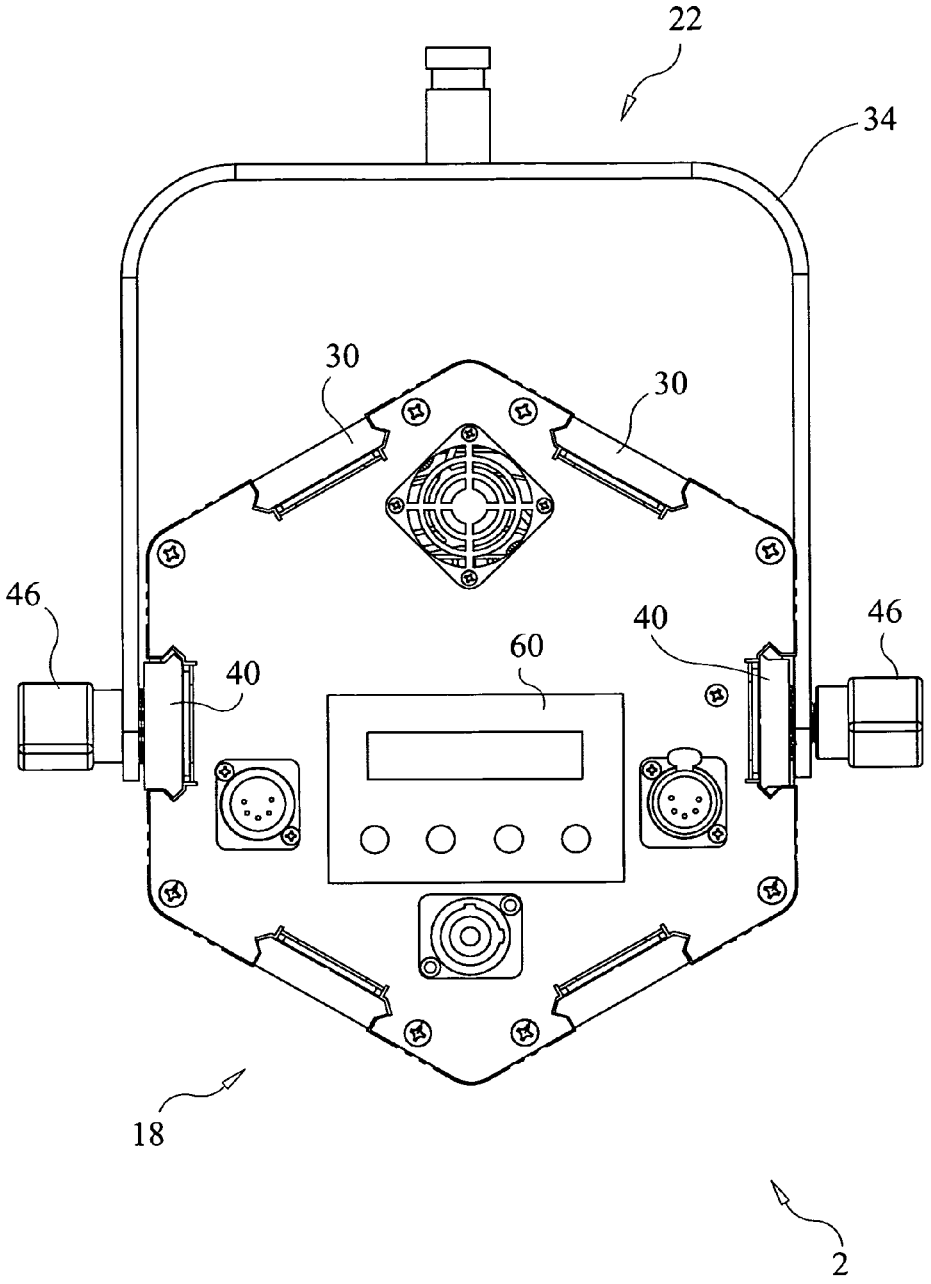
FIG. 15 is a rear perspective view of the lighting fixture of the present invention.
Figure 16:
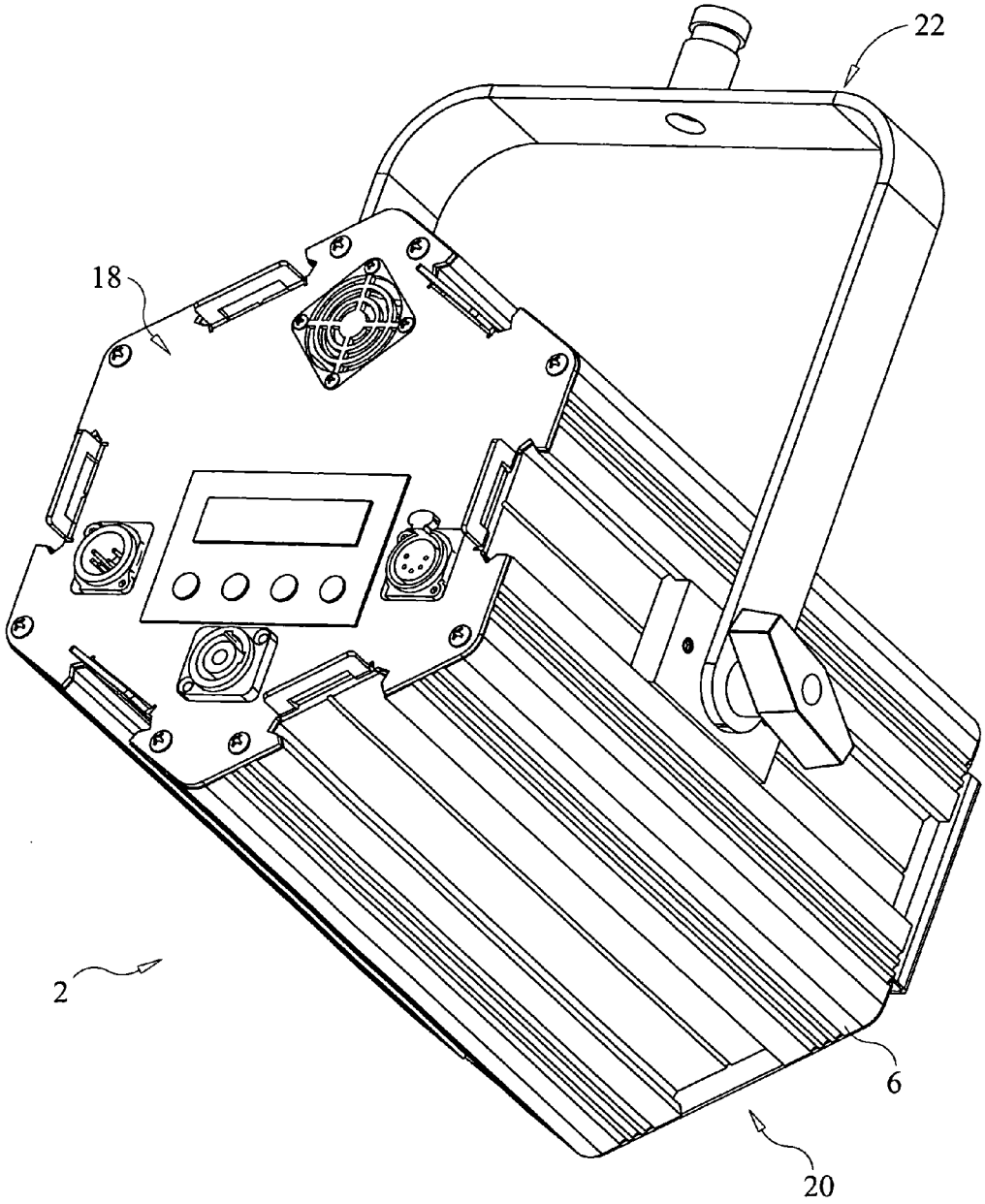
FIG. 16 is a bottom, rear perspective view of the lighting fixture of the present invention.
Figure 17:
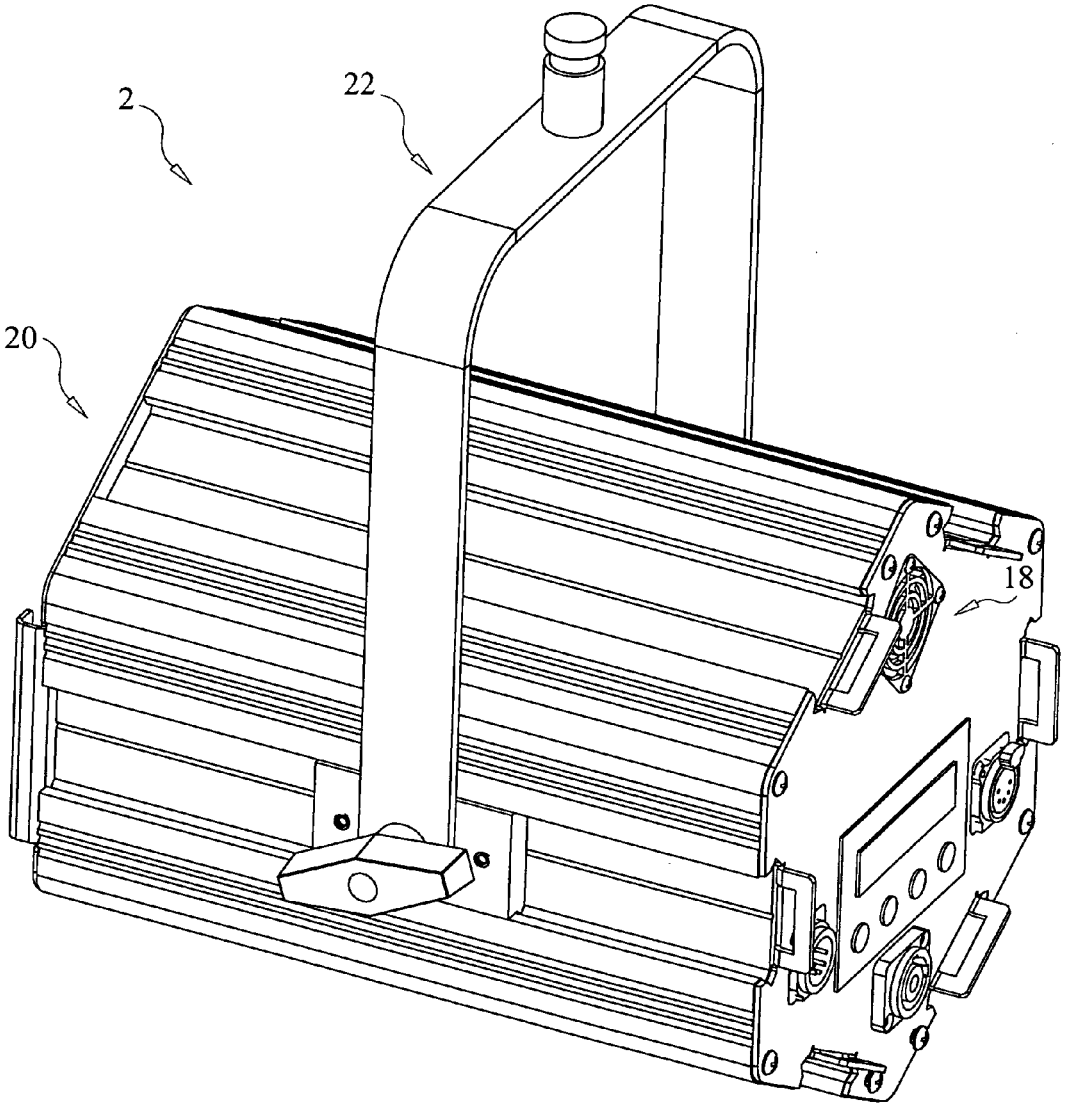
FIG. 17 is a top, rear perspective view of the lighting fixture of the present invention.
Figure 18:
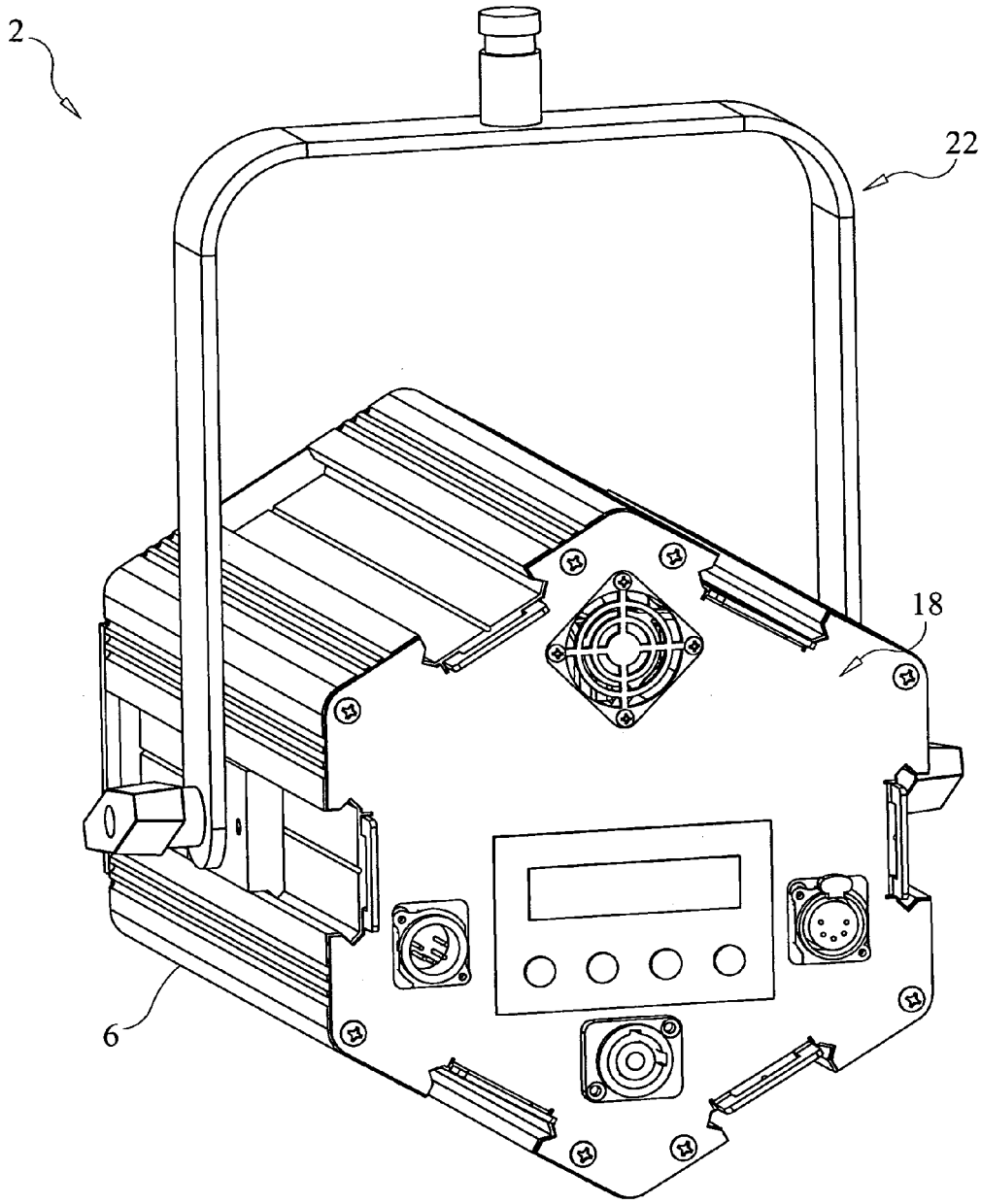
FIG. 18 is another rear perspective view of the lighting fixture of the present invention.
Figure 19:
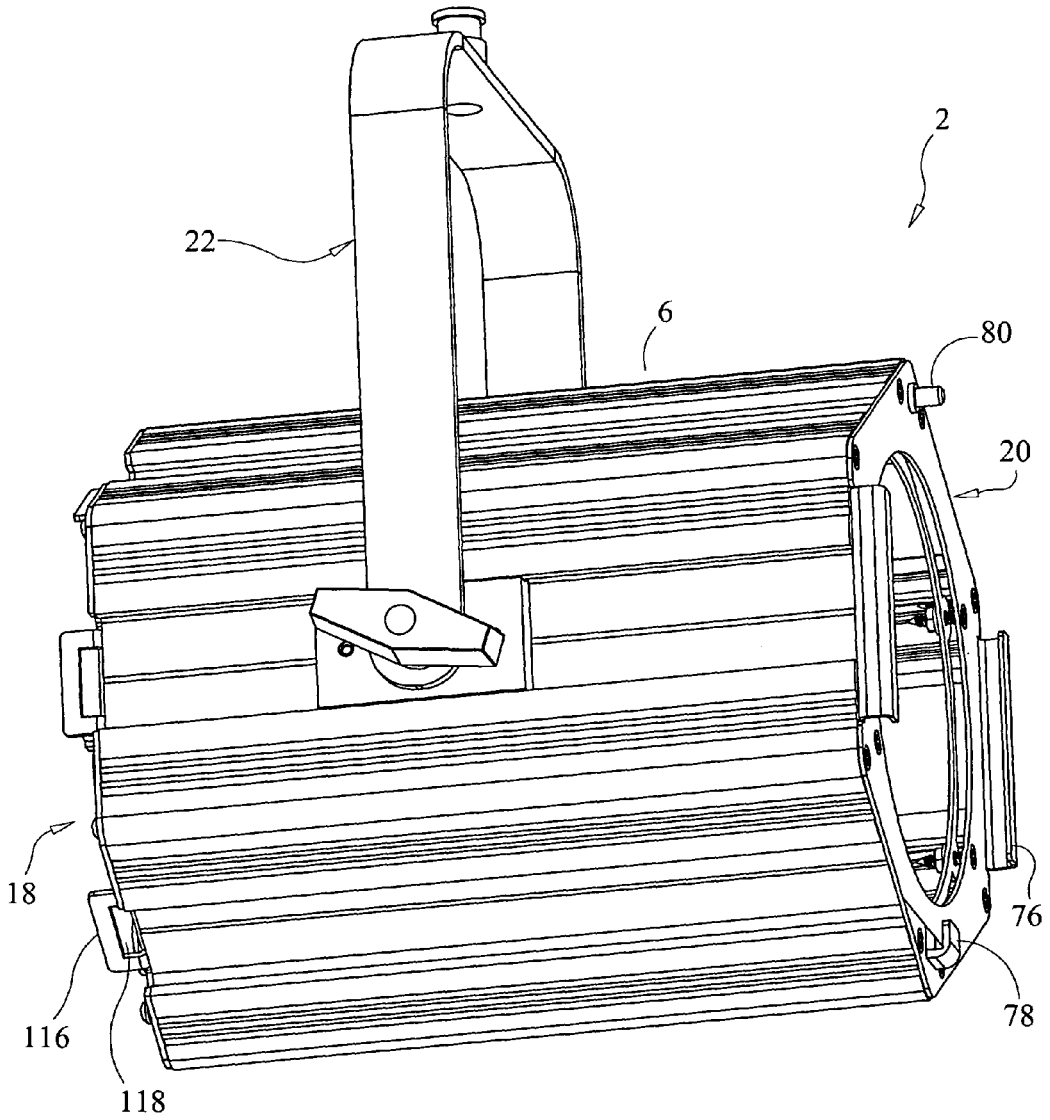
FIG. 19 is a side perspective view of the lighting fixture of the present invention, shown without a diffuser or lens mounted on the front side thereof.
Figure 20:
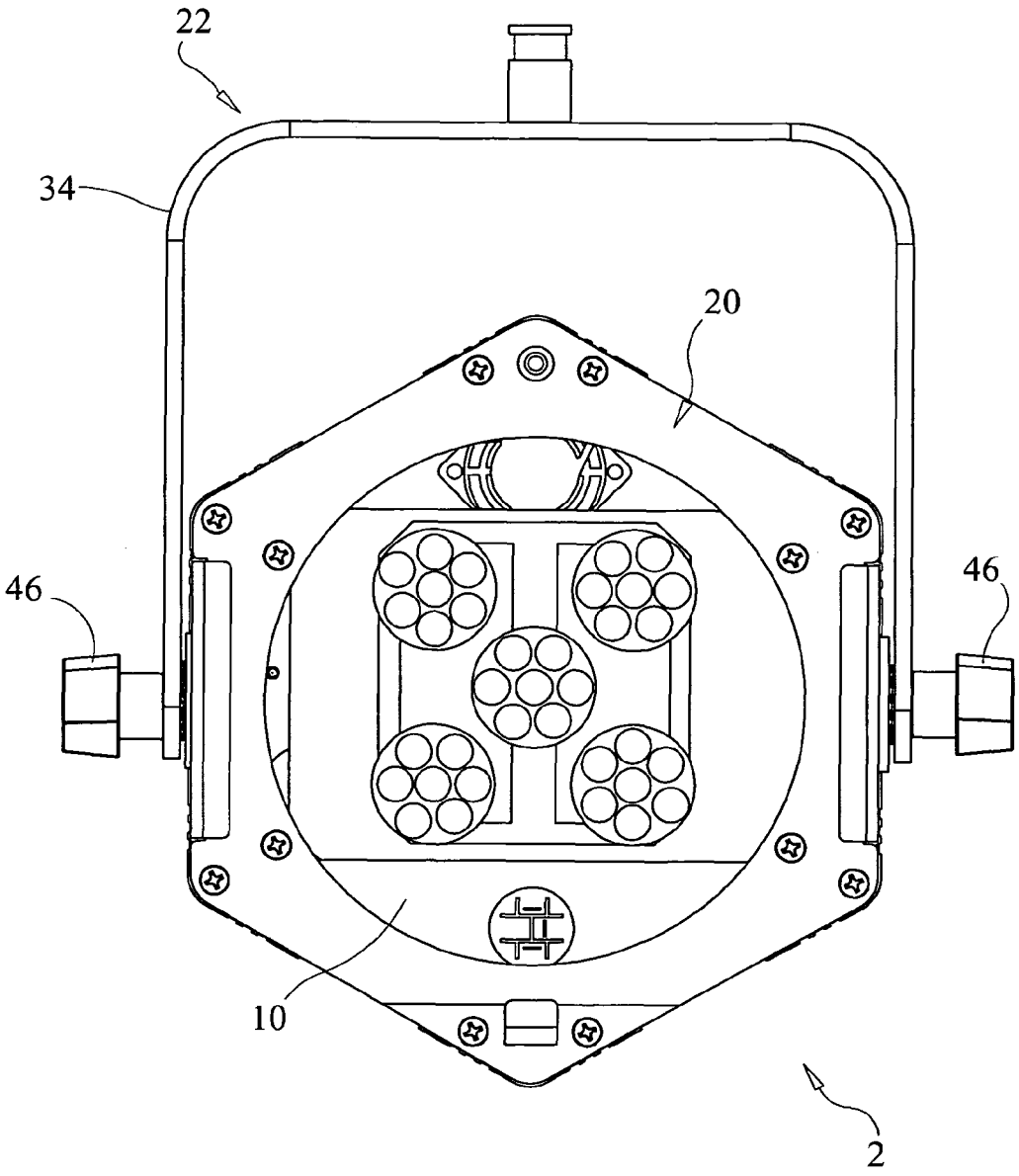
FIG. 20 is a front perspective view of the lighting fixture of the present invention, shown without a diffuser or lens mounted on the front side thereof.
Figure 21:
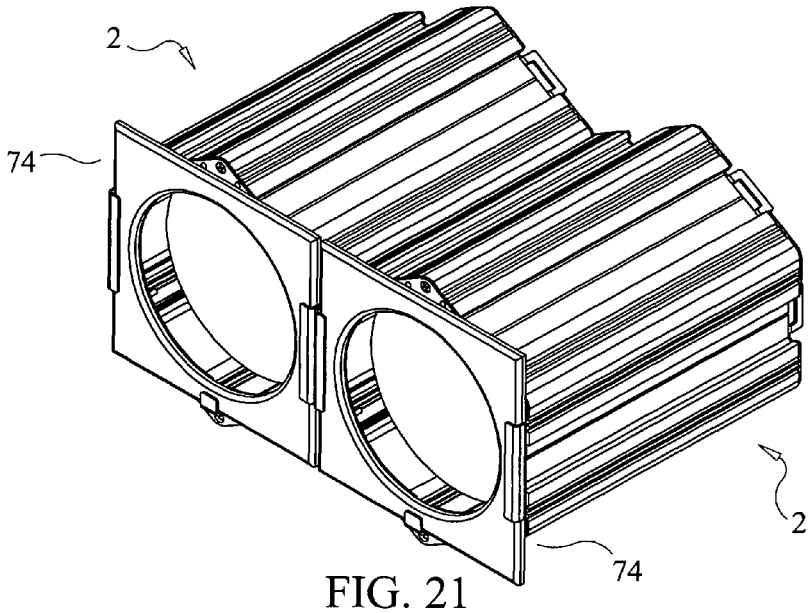
FIG. 21 is a front, top perspective view of a pair of lighting fixtures formed in accordance with the present invention joined together with an interlock piece, and illustrating a diffuser or lens mounted on the front side of each of the lighting fixtures.
Figure 22:
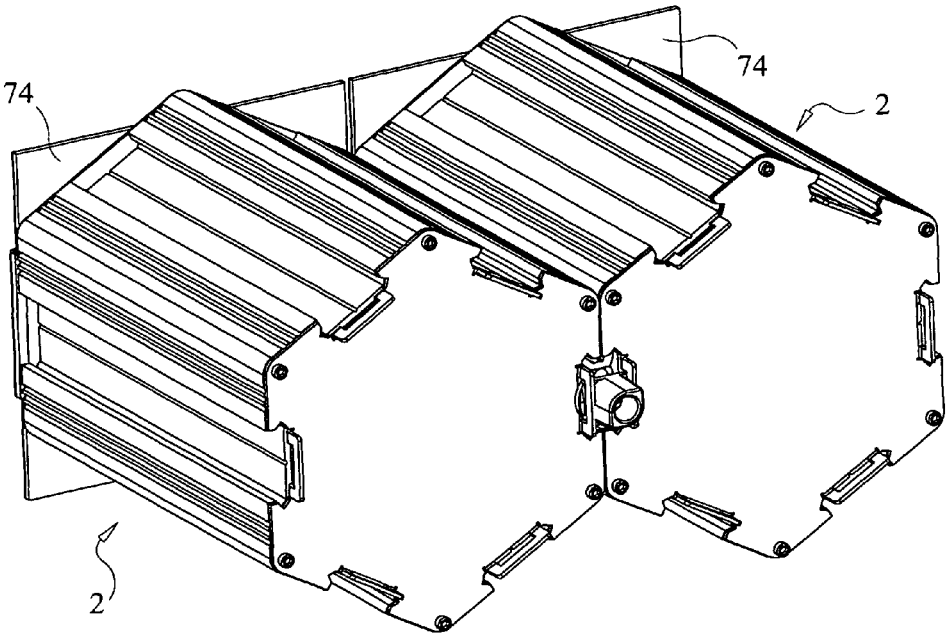
FIG. 22 is a top, rear perspective view of the pair of lighting fixtures of the present invention joined together with an interlock piece, each lighting fixture having a diffuser or lens mounted on the front side thereof.
Figure 23:
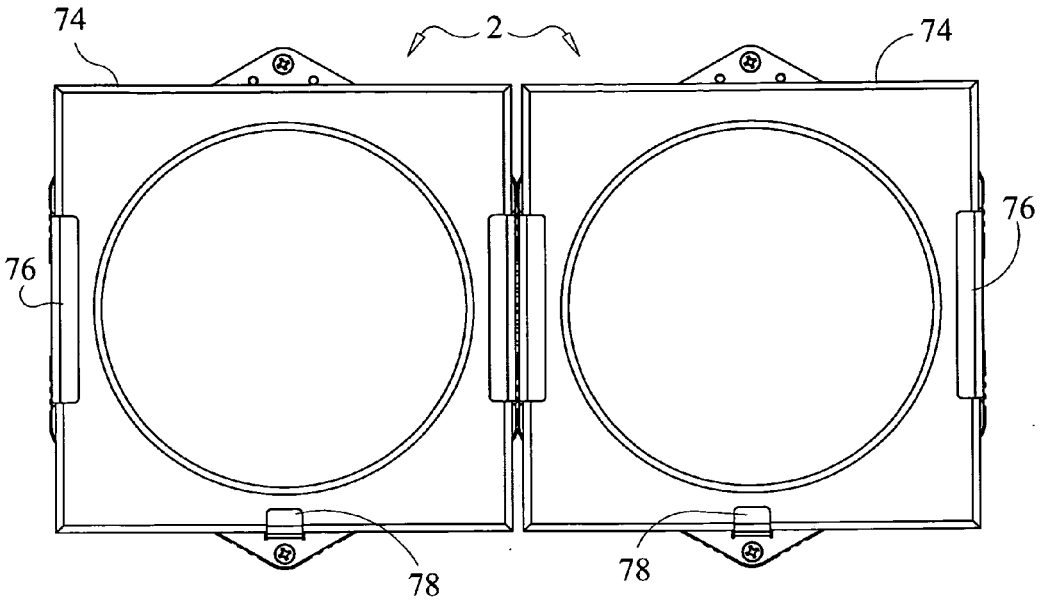
FIG. 23 is a front perspective view of the pair of lighting fixtures of the present invention joined together with an interlock piece, and showing a diffuser or lens mounted on the front side of each lighting fixture and held in place thereon.
Figure 24:
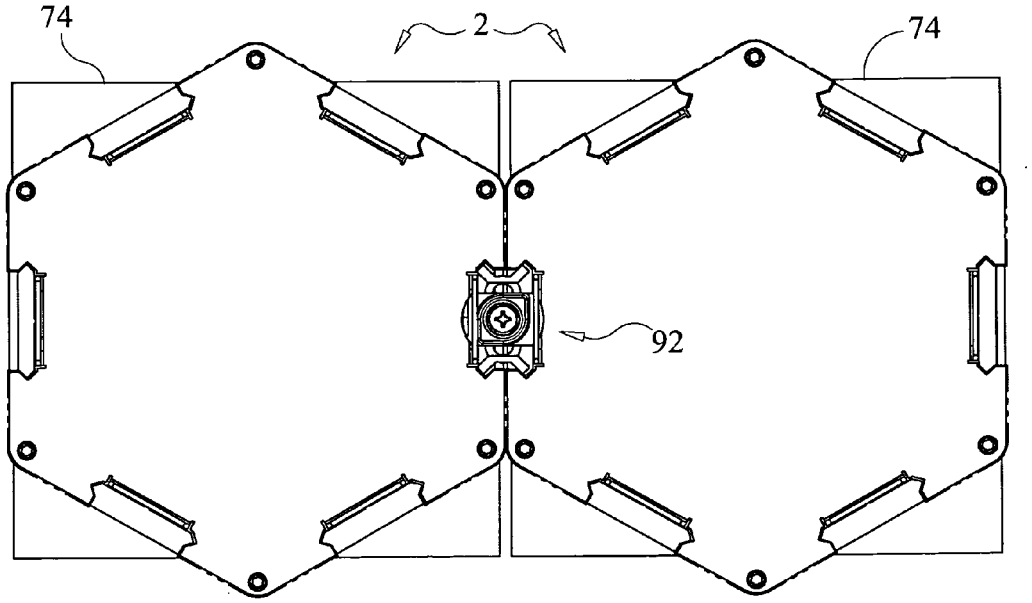
FIG. 24 is a rear perspective view of the pair of lighting fixtures of the present invention joined together with an interlock piece, and shown with a diffuser or lens mounted on the front side of each lighting fixture.
Figure 25:
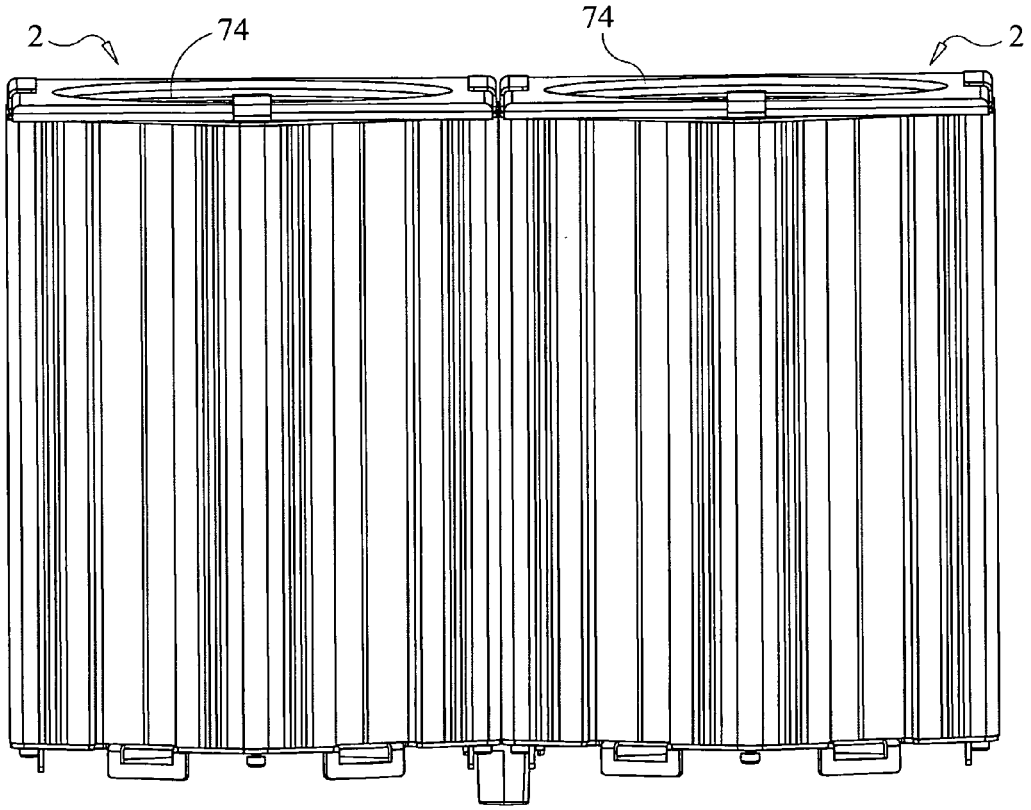
FIG. 25 is a top perspective view of the pair of lighting fixtures of the present invention joined together with an interlock piece, and shown with a diffuser or lens mounted on the front side of each lighting fixture.
Figure 26:
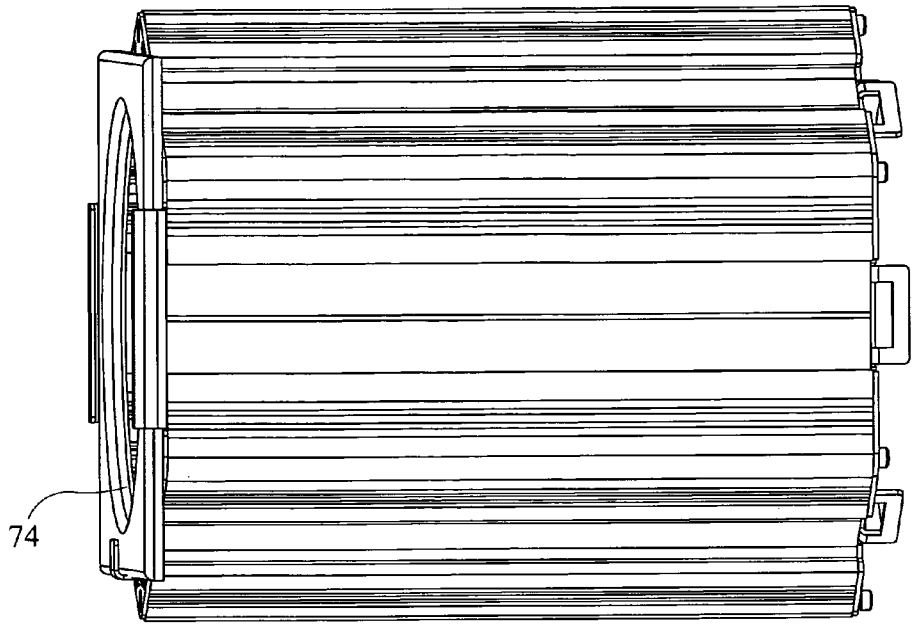
FIG. 26 is a side perspective view of the pair of lighting fixtures of the present invention joined together with an interlock piece, and shown with a diffuser or lens mounted on the front side of each lighting fixture.
Figure 27:
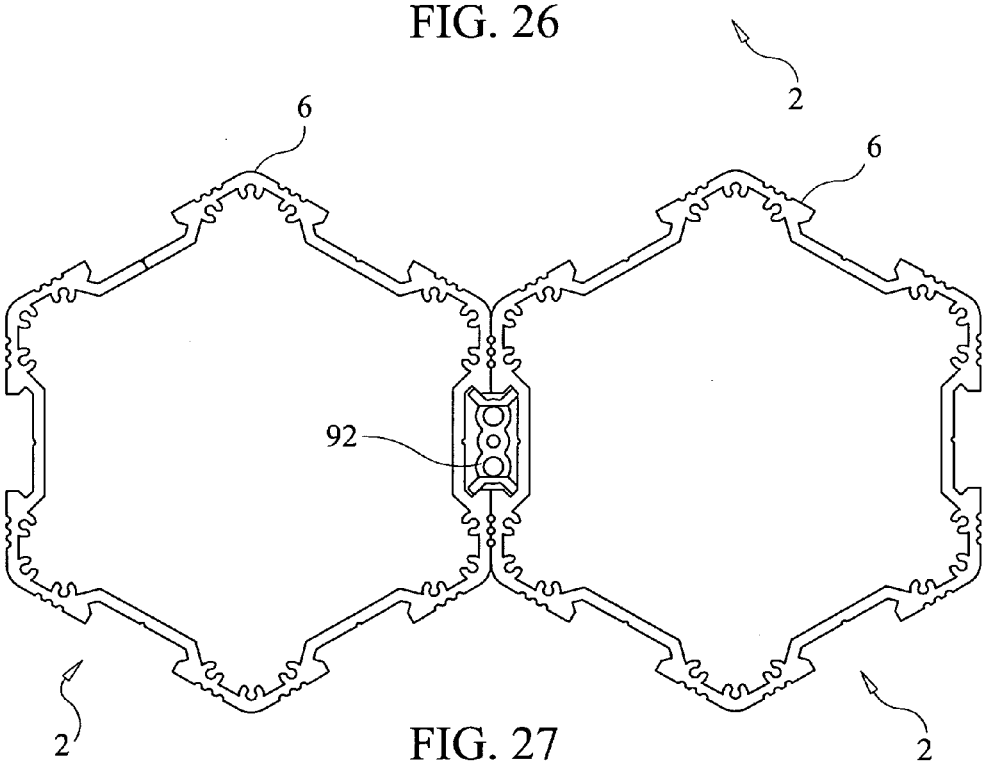
FIG. 27 is a transverse cross-sectional view illustrating a pair of lighting fixtures formed in accordance with the present invention joined together with an interlock piece.

Another arrangement of lighting fixtures 2 formed in accordance with the present invention is illustrated by FIG. 12. Here, again, six lighting fixtures 2, each having a hexagonally-shaped housing 4, are joined in close proximity to one another. Again, interlock pieces 92 are used to join adjacent side walls 8 of the lighting fixtures together.

In each of the modular arrangements shown in FIGS. 11 and 12, it can be seen that the lighting fixtures 2 have their light directed in the same direction to illuminate together an object, without requiring each lighting fixture to be individually adjusted as must be done with conventional, non-interlocking lighting fixtures. It should also be realized that the arrangements of lighting fixtures shown in FIGS. 11 and 12 are provided for exemplary purposes only, and such lighting fixtures may be arranged in a plurality of configurations to best suit the needs of the user.

Figure 28:
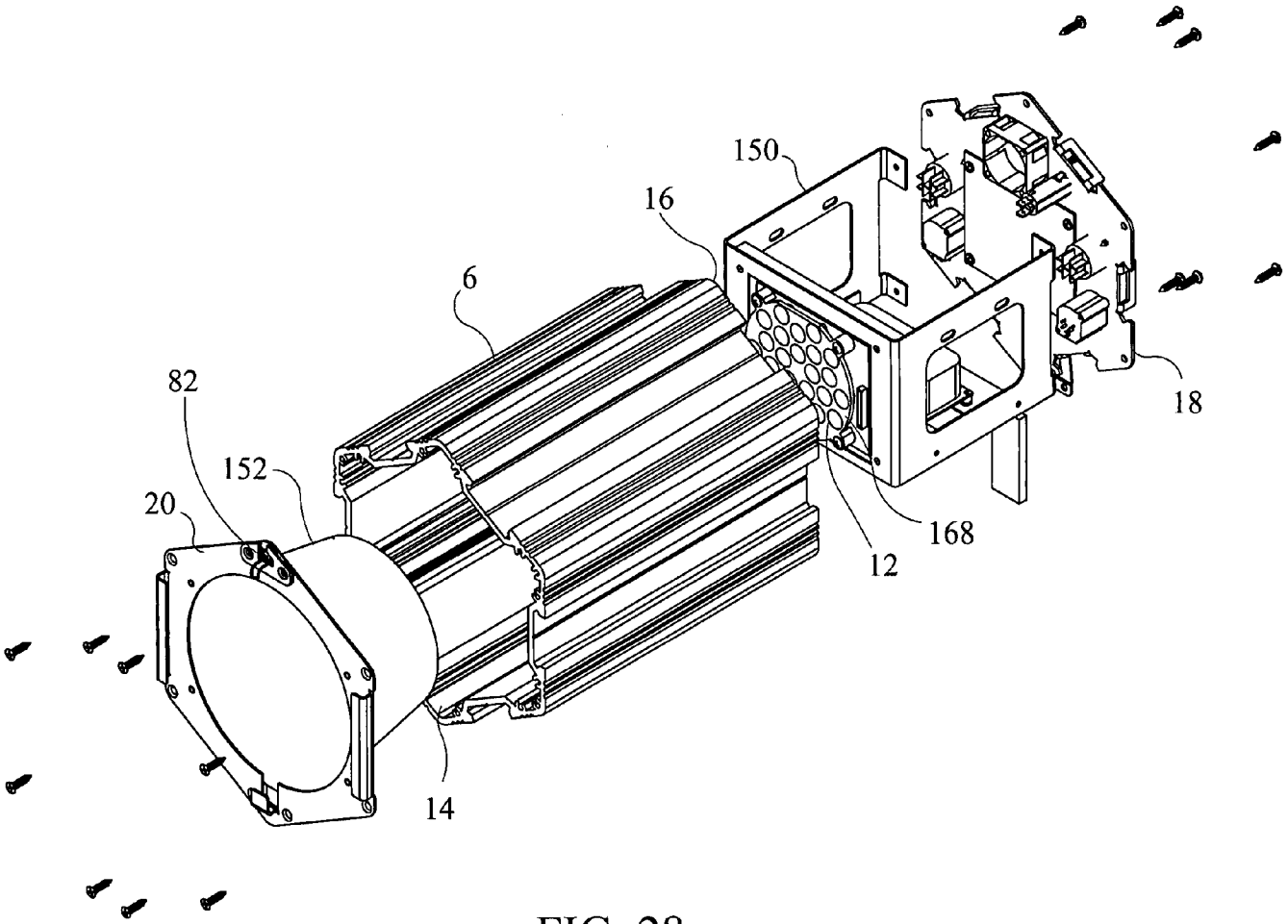
FIG. 28 is an exploded front isometric view of another form of the lighting fixture of the present invention.

Another form of a lighting fixture, and certain components thereof, constructed in accordance with the present invention, is shown in FIGS. 28-38. As shown in FIG. 28, the lighting fixture includes a main body 6 substantially having the features and structure described previously. Through the rear axial open end 16 of the main body 6 is received an internal slide assembly 150. On the front axial open end 14 of the main body 6 is received a reflector assembly 152 and diffuser holding fixture, also referred to herein as a front plate assembly 20.

As also can be seen from FIG. 28, a back plate assembly 18 is mounted on the rear open axial end 16 of the main body 6 of the fixture. The back plate assembly 18 is mounted on bent flanges 154 on the rear side of the internal slide assembly 150, which assembly is received within the internal cavity 10 of the main body 6.

Figure 29:
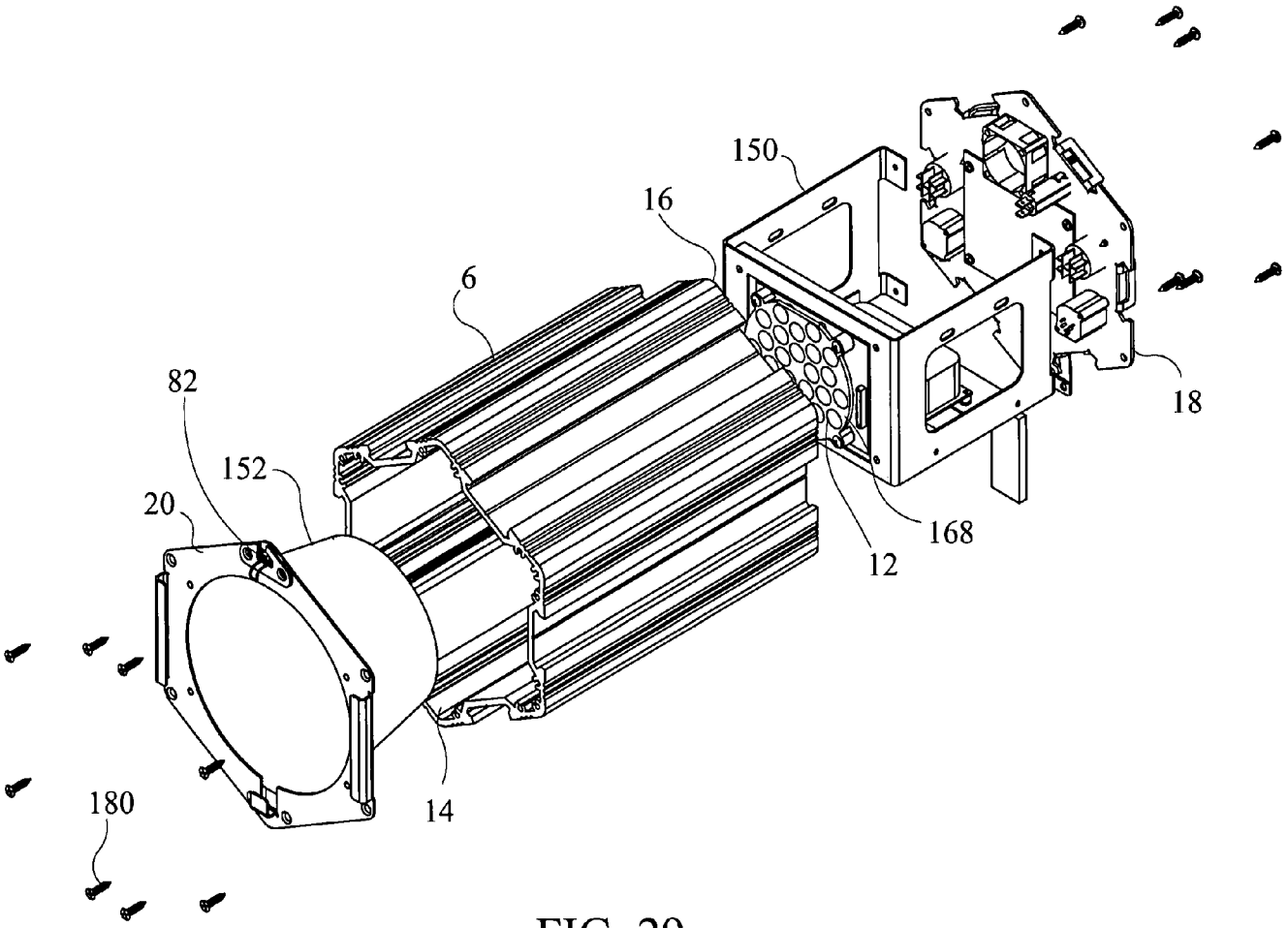
FIG. 29 is a more detailed, exploded front isometric view of the lighting fixture of the present invention shown in FIG. 28.

FIG. 29 is another view of the lighting fixture shown in FIG. 28. Although not shown in FIG. 29, a yoke hanger assembly 22, such as described previously with respect to the other embodiments of the lighting fixture, is adjustably mounted on the outer surface or side walls 8 of the main body 6. Furthermore, the reflector assembly 152 is received within the cavity 10 of the main body 6 of the lighting fixture through the open front axial end 14 thereof, and the front plate assembly 20 is mounted on the main body 6 on the open front end 14 thereof.

Figure 30:
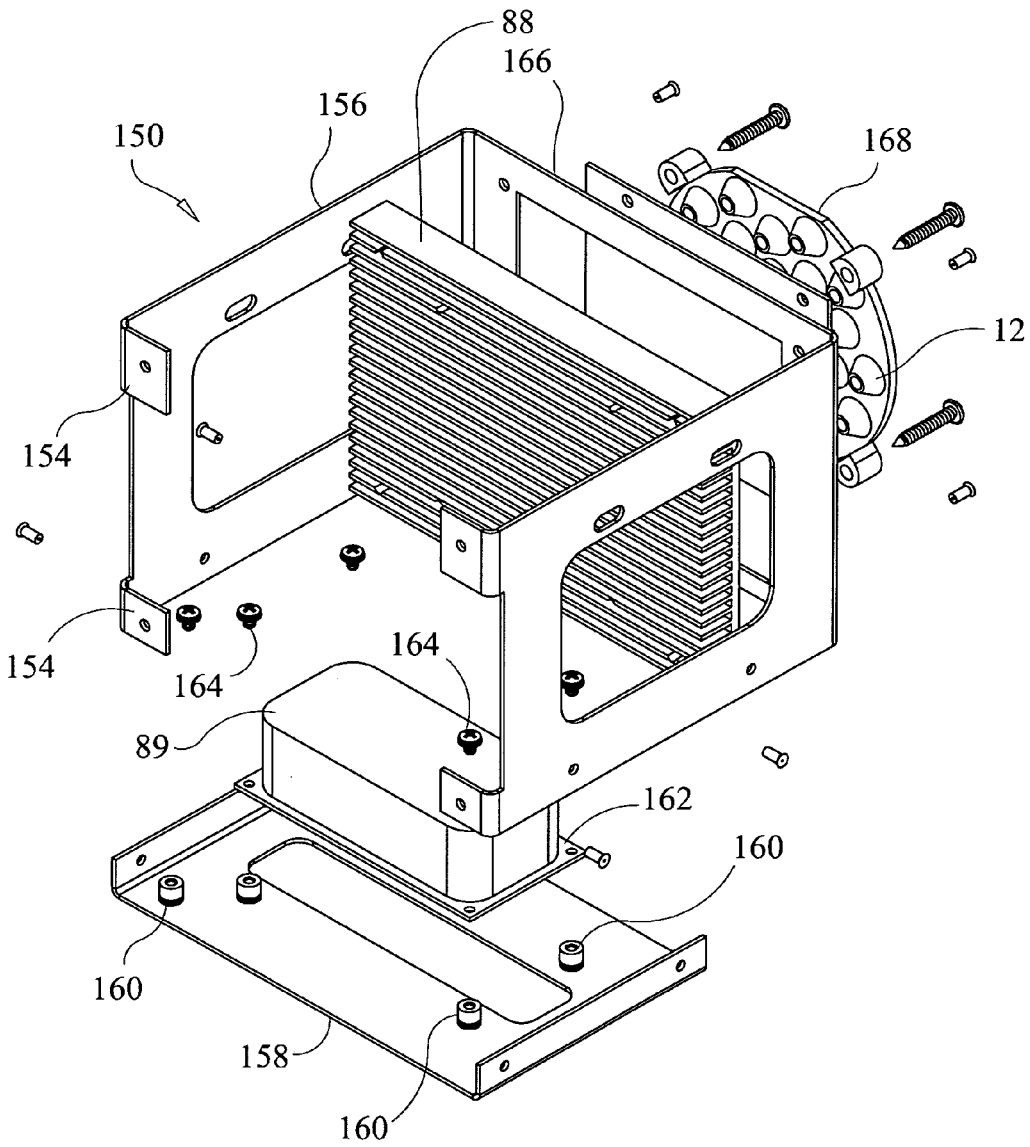
FIG. 30 is an exploded rear isometric view of a slide assembly of the lighting fixture shown in FIGS. 28 and 29.
Figure 31:
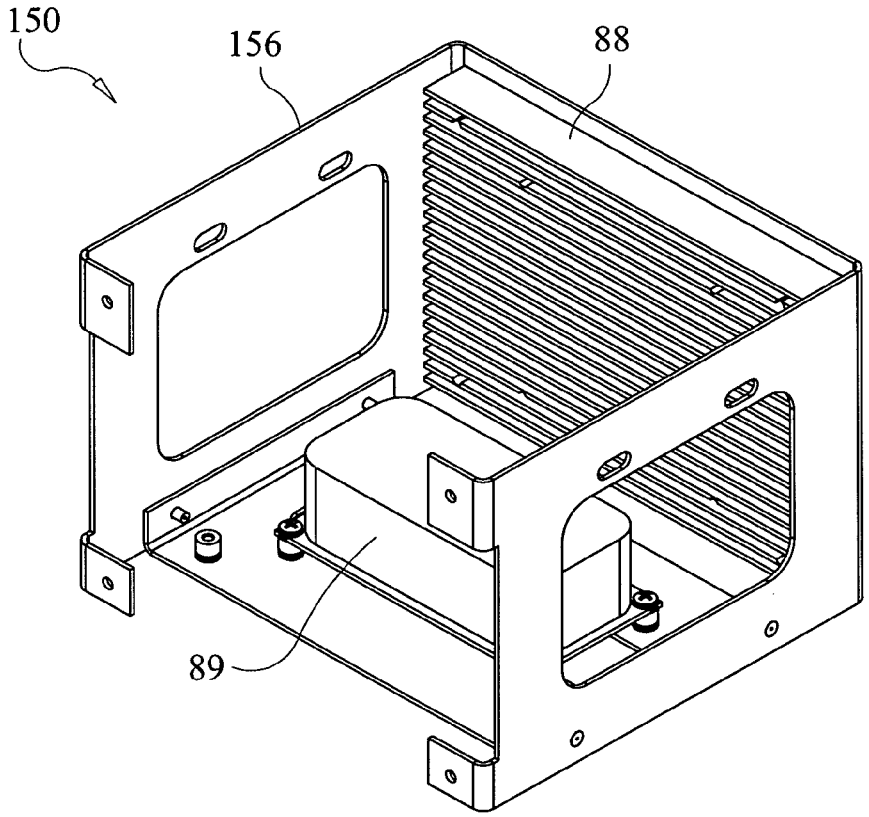
FIG. 31 is a rear isometric view of the slide assembly of the lighting fixture shown in FIG. 30 in an assembled form.

FIGS. 30 and 31 show in detail the structure of the internal slide assembly 150. Basically, the slide assembly includes a three-sided frame 156. A lower plate 158 with standoffs 160 is mounted on the bottom of the frame 156. The lower plate 158 supports a power supply 89 for the light emitting diodes (LEDs) 12, which preferably provides sixty-five (65) watts of power. The power supply 89 has a supporting flange 162 on the lower surface of its housing which is mounted to the standoffs 160 by screws 164.

Also mounted to the frame 156 of the internal slide assembly 150 is a finned heat sink 88. The heat sink 88 is mounted to a partially open front side 166 of the three-sided frame 156.

The optics assembly 168, which includes a plurality of LEDs 12, is mounted on the partially open front side 166 of the three-sided frame 156, and is thermally coupled to the heat sink 88 so that the heat sink may dissipate the heat generated by the plurality of LEDs 12.

The internal slide assembly 150 is advantageous in that the entire unit slides into and is affixed within the internal cavity 10 of the main body 6 of the lighting fixture, and may be removed as a single unit.

FIGS. 32-37 illustrate in detail the reflector assembly 152 and the front plate assembly 20 of the lighting fixture shown in FIGS. 28 and 29. As mentioned previously, the reflector assembly 152 is received through the open front axial end 14 of the main body 6, and is affixed to the front end 14 of the main body 6 by the front plate assembly 20. The reflector assembly 152 includes a reflector 170, and a reflector retaining ring 172. The reflector retaining ring 172 includes holes 174 formed therein which are aligned with openings or screw receivers 176 formed on the front face 14 of the main body 6 and with openings 178 formed in the front plate assembly 20, so that machine screws 180 may pass through the openings 178, 174 in the front plate assembly 20 and the reflector retaining ring 172 to hold the front plate assembly 20 and the reflector assembly 152 in place on the front face of the main body 6 of the lighting fixture. As can be seen in FIGS. 32, 33, 36 and 37 of the drawings, the reflector 170 has a truncated conical shape and is used to help direct light emitted by the plurality of LEDs 12 in an axial direction from the front of the lighting fixture.

Figure 32:
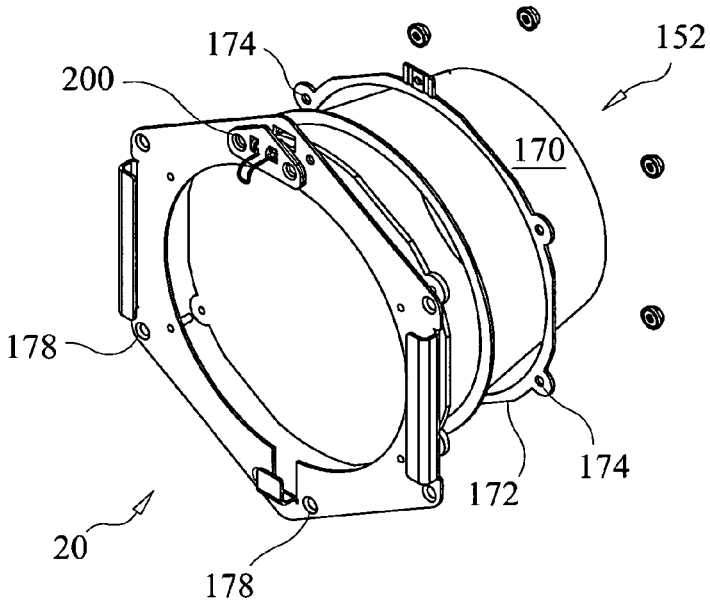
FIG. 32 is an exploded front isometric view of a reflector assembly of the lighting fixture of the present invention shown in FIGS. 28 and 29.
Figure 33:
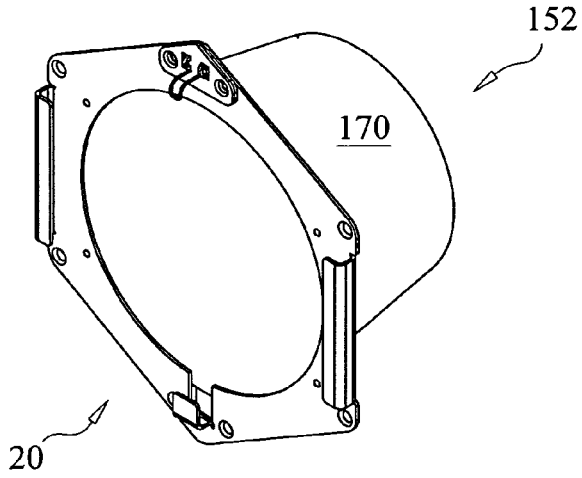
FIG. 33 is a front perspective view of the reflector assembly of the lighting fixture of the present invention shown in FIG. 32.

It should also be noted from FIGS. 32 and 33 that a spring clip attachment 200 is included and mounted to the front plate assembly 20. The spring clip attachment 200, which includes a resilient, partial coiled spring 202 having a hooked end 204 mounted on a bracket 206, is used to retain a diffuser lens on the front plate assembly 20. The spring clip attachment 200 is also shown in greater detail in FIGS. 34 and 35.

Figure 36:
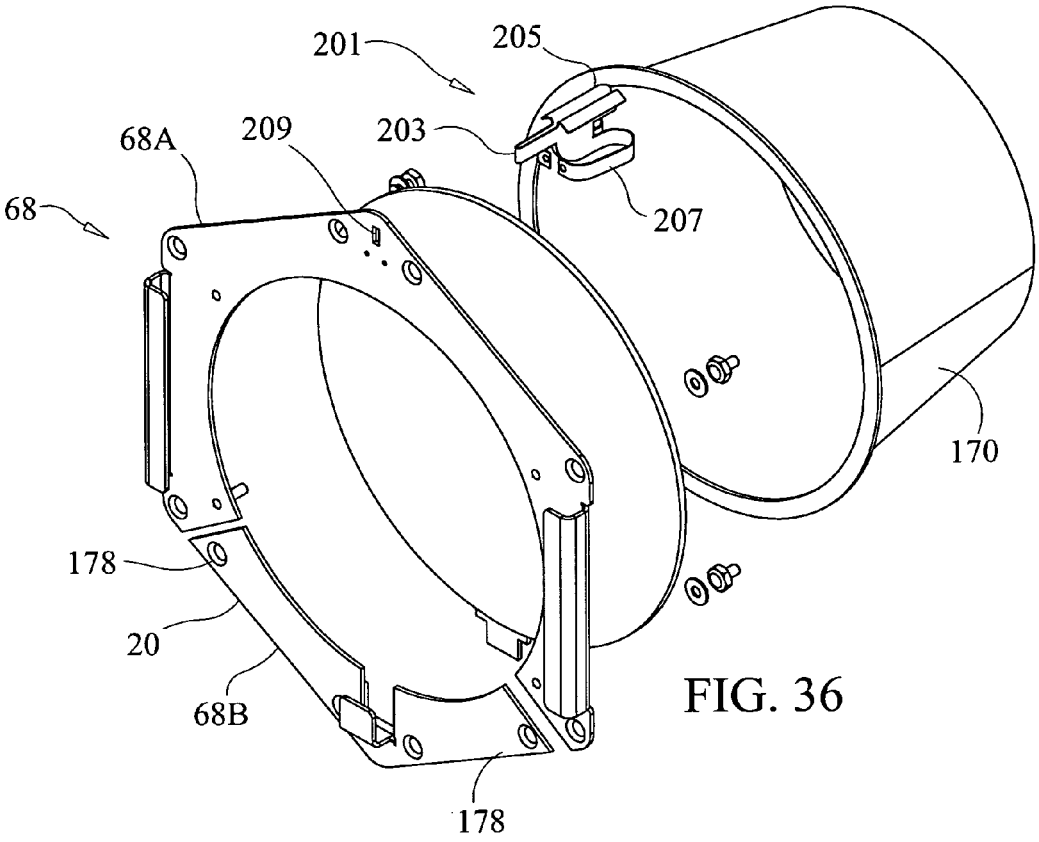
FIG. 36 is another exploded front isometric view of a reflector assembly of the lighting fixture of the present invention shown in FIG. 32.
Figure 37:
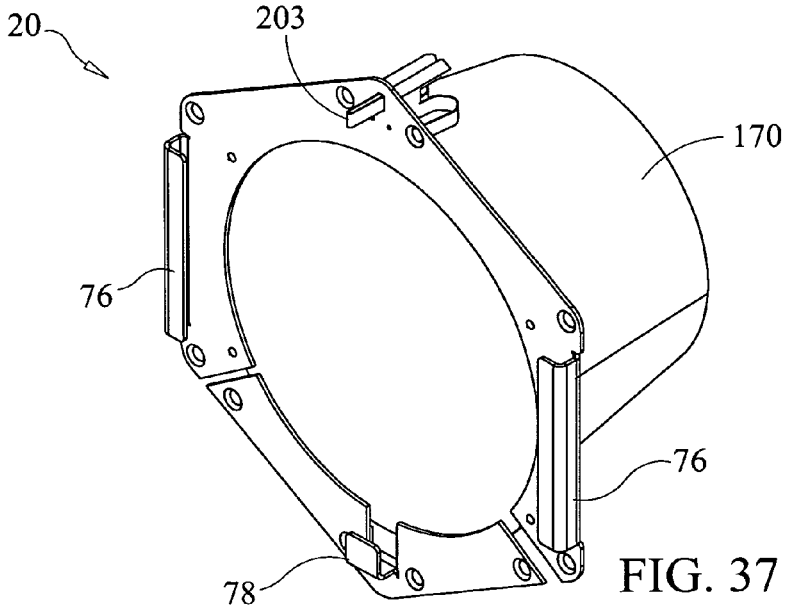
FIG. 37 is a front perspective view of the reflector assembly of the lighting fixture of the present invention shown in FIG. 36.

FIGS. 36 and 37 illustrate another form of a diffuser or lens retaining spring clip attachment 201 which is mounted on the front plate assembly 20. An elongated member 203 is attached to and between two generally L-shaped pieces 205 and extends outwardly therefrom. The L-shaped pieces 205 are, in turn, attached to two resilient, oblong leaf springs 207, whose ends are affixed to the rear surface of the front plate 68 of the front plate assembly. More specifically, in this embodiment, the front plate 68 is formed in two first and second sections, 68A and 68B, and the diffuser or lens retaining spring clip attachment 201 is mounted on the first section 68A. The elongated member 203 is received by and passes through an opening 209 formed through the thickness of the front plate 68 (more specifically, the first section 68A thereof), the opening 209 being shaped to conform to the cross-sectional shape of the elongated member 203. In much the same way as the spring pin 80, described previously, functions, the elongated member 203 may be pushed through the opening 209 and into the front plate 68 against the bias of the leaf springs 207 by the user as he is mounting the diffuser or lens 74 on the lighting fixture so that a diffuser or lens 74 may be received by the front plate assembly 20, and then released so as to protrude outwardly from the front face of the front plate 68, biased by the leaf springs 207, so as to retain the diffuser or lens 74 in place on the front plate assembly 20.

Figure 34:
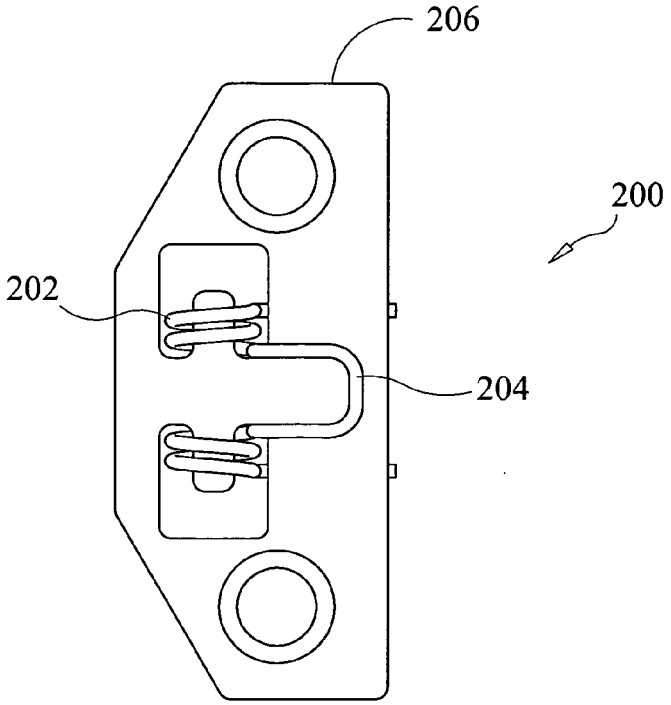
FIG. 34 is a top plan view of a spring clip attachment of the present invention used for holding a diffuser or lens in place on the fixture.
Figure 35:
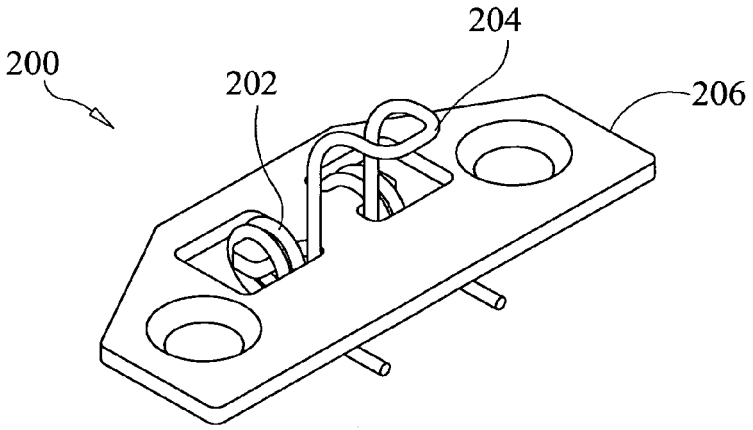
FIG. 35 is a perspective view of the spring clip attachment of the present invention shown in FIG. 34.
Figure 38:
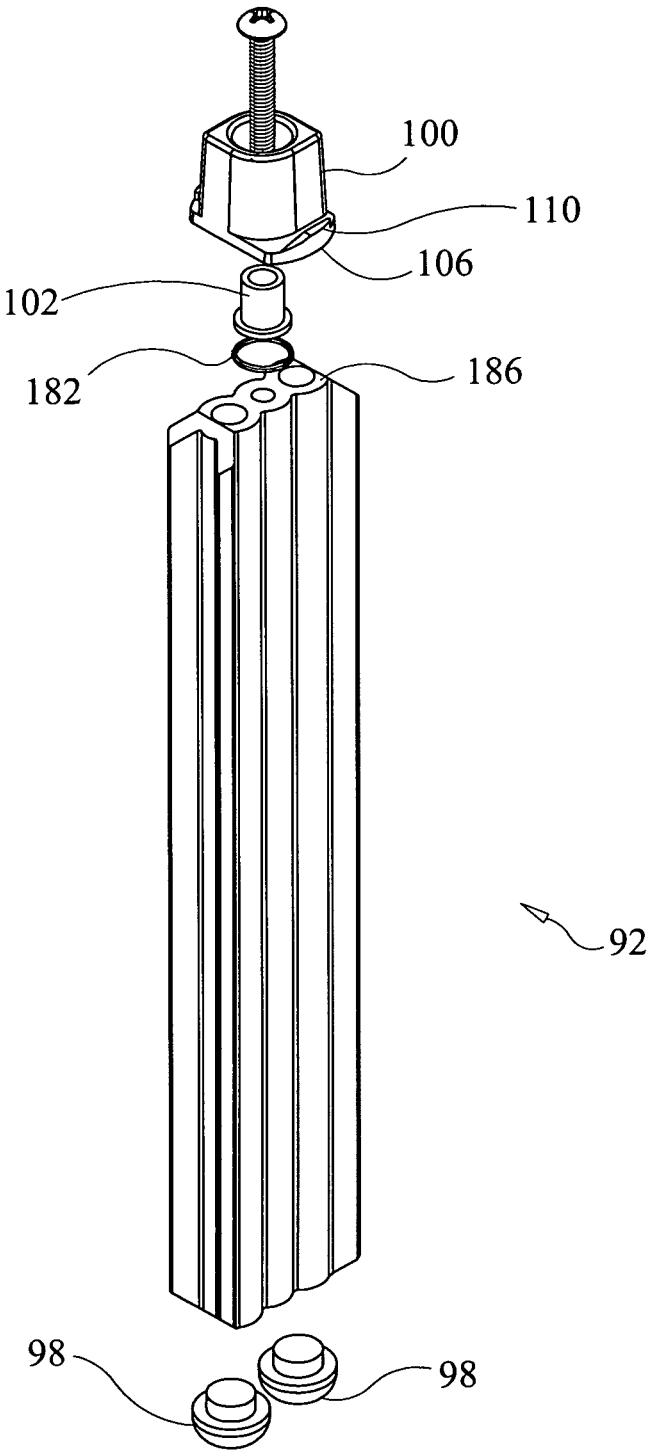
FIG. 38 is an exploded isometric view of an interlock assembly for use with the lighting fixture of the present invention shown in FIGS. 28 and 29.

FIG. 38 illustrates another form of the interlock assembly 92 used in the lighting fixture of the present invention. The features and structure of the interlock assembly 92 shown in FIG. 34 are substantially the same as those shown in FIGS. 8-10 of the drawings. However, a helical spring 182 has been added, surrounding a bushing 102 on which the interlock locking knob 100 is mounted. The helical spring 182 is situated between an end face 186 of the interlock extrusion 92 and the bottom surface of the locking knob 100.

The purpose of the spring 182 is to exert an axially outward force on the locking knob 100 so as to ensure that the raised lips 110 on the protruding flanges 106 (see FIG. 9) engage the slots 118 of the U-shaped catches 116 (see FIG. 4).

To summarize some of the features of the present invention, a lighting fixture 2, constructed in accordance with the present invention, includes a housing 4. The housing 4 has an overall polygonal shape and includes a plurality of generally planar side walls 8. The housing further 4 defines an interior space. Each side wall 8 of the polygonally-shaped housing includes cooperating structure which allows one of the side walls 8 of the housing 4 of the lighting fixture 2 to be interlocked with a generally planar side wall 8 of the housing 4 of another similarly-structured lighting fixture 2.

The lighting fixture 2 also includes an interlock piece 92, the interlock piece 92 being attachable to the cooperating structure of a side wall 8 of the housing 4 of the lighting fixture 2 and to cooperating structure of a side wall 8 of the housing 4 of another similarly-structured lighting fixture 2 to join the lighting fixture 2 and a similarly-structured lighting fixture 2 together to form a modular arrangement of lighting fixtures.

Stated another way, the lighting fixture 2 basically includes the housing 4 and the interlock piece 92. The housing 4 includes a main body 6 having an overall polygonal shape and including a plurality of generally planar side walls 8, the main body 6 defining an interior space. Each side wall 8 of the polygonally-shaped main body 6 of the housing 4 has an outer surface and an elongated channel 30 formed in the outer surface. The interlock piece 92 has an elongated member 94 which is at least partially receivable by the elongated channel 30 formed in each side wall 8 of the main body 6 of the housing 4 to interconnect the lighting fixture 2 with another, similarly-structured lighting fixture 2.

Preferably, the elongated channel 30 formed in the outer surface of each side wall 8 of the main body 6 of the housing 4 has a dovetail transverse cross-sectional shape, each side wall 8 of the main body 6 having a recessed portion 28 formed in the outer surface thereof and two laterally opposite portions 32 which face each other and partly overhang the recessed portion 28. Thus, the recessed portion 28 of each side wall 8 and the two laterally opposite portions 32 of the each side wall 8 at least partially define the elongated channel 30 formed in the outer surface of each side wall 8 of the main body 6.

There is at least one light emitting device 12 disposed within the interior space defined by the main body 6 of the housing 4. Furthermore, the lighting fixture 2 includes electronic circuitry 24 electrically coupled to the at least one light emitting device 12 to control the illumination thereof.

Even more preferably, the lighting fixture 2 of the present invention includes a slide frame assembly 150, the slide frame assembly 150 being removably mounted within the interior space defined by the main body 6 of the housing 4. The slide frame assembly 150 has mounted thereon the at least one light emitting device 12 and the electronic circuitry 24.

The main body 6 of the housing 4 of the lighting fixture 2 preferably includes a front side 14 and a rear side 16 situated axially opposite the front side 14, and the housing 4 preferably includes a rear plate assembly 18 mounted to the main body 6 at the rear side 16 thereof, and a front plate assembly 20 mounted to the main body 6 at the front side 14 thereof, the at least one light emitting device 12 being situated in the interior space of the main body 6 to emit light that is directed towards the front plate assembly 20.

The rear plate assembly 18 includes a rear plate 50, the rear plate 50 being generally planar in shape and having an outer periphery which conforms to the overall polygonal shape of the main body 6 of the housing 4. The rear plate assembly 18 further includes a power connector 56 and a control signal connector 58, each of the power connector 56 and the control signal connector 58 being mounted on the rear plate 50.

Preferably, the rear plate assembly 18 further includes a control panel 60, the control panel 60 being mounted on the rear plate 50 and including a display 62 and a plurality of switches 64 so that a user of the lighting fixture 2 may input control commands to the lighting fixture to control the illumination of the at least one light emitting device 12. The rear plate 50 may also be formed with a plurality of open slots 66 situated about the periphery thereof, the open slots 66 being spaced apart from each other, each open slot 66 being aligned with a corresponding channel 30 formed in a side wall 8 of the main body 6 of the housing 4.

The front plate assembly 20 preferably includes a front plate 68, the front plate 68 being generally planar in shape. Also, each elongated channel 30 formed in the side walls 8 of the main body 6 of the housing 2 includes a first axial end situated near the front side 14 of the main body 6 of the housing 2 and a second axial end situated opposite the first axial end and near the rear side 16 of the main body 6 of the housing 4. Furthermore, the front plate 68 preferably includes portions 69 thereof which extend outwardly to cover the first axial end of each elongated channel 30 formed in the side walls 8 of the main body 6 of the housing 4, the portions 69 acting as stops which are engagable by the interlock piece 92.

In another preferred form of the lighting fixture 2 of the present invention, the front plate 68 includes a front surface, and the front plate assembly 20 further includes a pair of L-shaped brackets 76. The L-shaped brackets 76 are situated on the front surface of the front plate 68 and extend outwardly therefrom, the L-shaped brackets 76 being spaced apart from each other to receive therebetween one of a lens and a diffuser 74.

Also, the front plate assembly 20 further preferably includes a mechanism for selectively holding the one of the lens and the diffuser 74 in place between the pair of L-shaped brackets 76 on the front surface of the front plate 68. In one form, the mechanism includes a retractable spring member 80, 203 mounted on the front plate 68, the spring member 80, 203 being selectively positionable in at least a first position in which the spring member 80, 203 extends outwardly from the front surface of the front plate 68 a first distance, and a second position in which the spring member 80, 203 at least one of 1) does not extend outwardly from the front surface of the front plate 68, and 2) extends outwardly from the front surface of the front plate 68 a second distance, the first distance being greater than the second distance. In another form, the mechanism includes a resilient, partially coiled spring 202 having a hooked end 204, the hooked end 204 of the spring 202 being selectively positionable in at least a first position to retain the one of the lens and the diffuser 74 in place on the front surface of the front plate 68, and a second position to allow the one of the lens and the diffuser 74 to be removed from a position on the front surface of the front plate 68.

The lighting fixture 2 also preferably includes a hanger assembly 22, the hanger assembly 22 being mountable to the main body 6 of the housing 4. The hanger assembly 22 includes at least one hanger block 40, the at least one hanger block 40 being receivable in the elongated channel 30 formed in one of the side walls 8 of the main body 6 and being selectively positionable along the axial length of the elongated channel 30.

In a more preferred form, the hanger assembly 22 includes a hanger piece 34 formed as a generally U-shaped member, the hanger piece 34 including a central cross leg 36 having opposite axial ends, and first and second opposite side legs 38 extending at an angle from the opposite axial ends of the central cross leg 36. Each of the first and second side legs 38 has a free end. The hanger assembly 22 further includes first and second hanger blocks 40, the first hanger block 40 being mounted to the free end of the first side leg 38, and the second hanger block 40 being mounted to the free end of the second side leg 38. The first and second hanger blocks 40 are receivable by elongated channels 30 formed in respective side walls 8 of the main body 6 of the housing 2 and are selectively positionable along the axial lengths of the elongated channels 30.

The interlock piece 92 of the lighting fixture 2, in a preferred form, includes a generally elongated member 94 having a pair of laterally conjoined tubular members 96, the elongated member 94 having a first axial end and a second axial end disposed opposite the first axial end. Each tubular member 96 has a first axial end situated in proximity to the first axial end of the elongated member 94, and a second axial end situated opposite the first axial end of the tubular member 96. The interlock piece 92 further includes a resilient cushioning piece 98 situated at the first axial end of each tubular member 96, and a rotatable fastener 100 mounted on the second axial end of the elongated member 94.

Furthermore, each tubular member 96 includes at least one projection extending radially outwardly therefrom along at least a portion of the longitudinal length thereof, the radially extending projection of each tubular member 96 being receivable by the elongated channel 30 formed in a respective side wall 8 of the main body 6 of the housing 4. Preferably, the at least one projection includes first and second angled fins 112, 114 spaced apart from each other and extending radially outwardly from the outer surface of each tubular member 96, the first and second angled fins 112, 114 of one of the tubular members 96 being receivable by the elongated channel 30 formed in a respective side wall 8 of the main body 6 of the housing 4.

The rotatable fastener 100 of the interlock piece 92 preferably includes a main body 104 and a pair of flanges 106 extending outwardly from the main body 104 of the fastener 100. As mentioned previously, the main body 6 of the housing 4 of the lighting fixture 2 includes a front side 14 and a rear side 16 situated axially opposite the front side 14. Also, each elongated channel 30 formed in the side walls 8 of the main body 6 of the housing 4 includes a first axial end situated near the front side 14 of the main body 6 of the housing 4 and a second axial end situated opposite the first axial end and near the rear side 16 of the main body 6 of the housing 2. As also mentioned previously, the housing 4 further includes a rear plate assembly 18 mounted to the main body 6 of the housing 4 at the rear side 16 thereof, and a front plate assembly 20 mounted to the main body 6 of the housing 4 at the front side 14 thereof. The rear plate assembly 18 includes a rear plate 50, the rear plate 50 being generally planar in shape, and the front plate assembly 20 includes a front plate 68, the front plate 68 being generally planar in shape and having portions 69 thereof which extend outwardly to cover the first axial end of each elongated channel 30 formed in the side walls 8 of the main body 6 of the housing 4. These portions 69 act as stops which are engagable by the cushioning piece 98 situated at the first axial end of one of the tubular members 96 of the interlock piece 92. Also, the rear plate 50 of the rear plate assembly 18 has an outer surface, and the rear plate assembly 18 further includes a plurality of U-shaped catches 116 extending outwardly from the outer surface of the rear plate 50.

The catches 116 are spaced apart from each other and situated in alignment with corresponding channels 30 formed in the side walls 8 of the main body 6 of the housing 4. Each U-shaped catch 116 at least partially defines a slot 118 for receiving one of the protruding flanges 106 of the fastener 100 of the interlock piece 92 to help hold the interlock piece 92 in place at least partially within an elongated channel 30 of a respective side wall 8 of the main body 6 of the housing 4 in which the interlock piece 92 is at least partially received.

The present invention is also directed to a modular arrangement of a plurality of lighting fixtures 2, adjacent lighting fixtures 2 being joined together. As mentioned previously, each lighting fixture 2 of the modular arrangement basically includes a housing 4, the housing 4 including a main body 6 having an overall polygonal shape and including a plurality of generally planar side walls 8, the main body 6 defining an interior space. Each side wall 8 of the polygonally-shaped main body 6 of the housing 4 has an outer surface and an elongated channel 30 formed in the outer surface. The modular arrangement also includes one or more interlock pieces 92. The interlock piece 92 has an elongated member 94 which is at least partially receivable by the elongated channel 30 formed in each side wall 8 of the main body 6 of the housing 4 to interconnect the lighting fixture 2 with another, similarly-structured lighting fixture 2 of the modular arrangement.

The fixture 2 of the present invention further includes two additional features referred to herein by the trademarks FlexPalette™ and FlexRate™. The FlexPalette™ feature allows the user of the lighting fixture 2 to select and record in memory approximately 100 static colors. More specifically, the lighting fixture 2 of the present invention offers standalone operation with user-programmable features of preferably 100 user-programmable color memory locations and preferably 80 user-selectable combinations of fade and/or bump timing.

The FiexRate™ feature of the lighting fixture 2 precludes strobing caused by ambient light conditions, such as when a room or stage is illuminated by fluorescent lighting. Thus, emitter output is flicker-free and includes preferably a selection of four output frequencies for each of the four DMX (digital multiplex) modes. PWM (pulse width modulation) control of LED levels is imperceptible to video cameras and similar equipment.

The lighting fixture of the present invention is envisioned to be used in many different applications, including commercial, industrial and stage lighting, and where either LEDs are used as described herein, or other light emitting devices, such as incandescent lamps, may be substituted for the LEDs. For example, the lighting fixture may be used as traffic lights or other signal devices, as well as in horticultural applications, where the LEDs are replaced with plasma light sources.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A lighting fixture, which comprises:

a housing, the housing including a main body having an overall polygonal shape and including a plurality of generally planar side walls, the main body defining an interior space, each side wall of the polygonally-shaped main body of the housing having an outer surface and an elongated channel formed in the outer surface; and an interlock piece, the interlock piece having an elongated member which is at least partially receivable by the elongated channel formed in each side wall of the main body of the housing to interconnect the lighting fixture with another, similarly-structured lighting fixture;

wherein the elongated channel formed in the outer surface of each side wall of the main body of the housing includes a dovetail transverse cross-sectional shape, each side wall of the main body having a recessed portion formed in the outer surface thereof and two laterally opposite portions which face each other and partly overhang the recessed portion, whereby the recessed portion of each side wall and the two laterally opposite portions of the each side wall at least partially define the elongated channel formed in the outer surface of each side wall of the main body.

2. A lighting fixture as defined by claim 1, which further comprises:

at least one light emitting device disposed within the interior space defined by the main body of the housing; and electronic circuitry electrically coupled to the at least one light emitting device to control the illumination thereof.

3. A lighting fixture as defined by claim 2, which further comprises:

a slide frame assembly, the slide frame assembly being removably mounted within the interior space defined by the main body of the housing, the slide frame assembly having mounted thereon the at least one light emitting device and the electronic circuitry.

4. A lighting fixture as defined by claim 2, wherein the main body of the housing includes a front side and a rear side situated axially opposite the front side;

and wherein the housing further includes:

a rear plate assembly mounted to the main body at the rear side thereof; and a front plate assembly mounted to the main body at the front side thereof, the at least one light emitting device being situated in the interior space of the main body to emit light that is directed towards the front plate assembly.

5. A lighting fixture as defined by claim 4, wherein the rear plate assembly includes a rear plate, the rear plate being generally planar in shape and having an outer periphery which conforms to the overall polygonal shape of the main body of the housing.

6. A lighting fixture as defined by claim 5, wherein the rear plate assembly further includes a power connector and a control signal connector, each of the power connector and the control signal connector being mounted on the rear plate.

7. A lighting fixture as defined by claim 5, wherein the rear plate assembly further includes a control panel, the control panel being mounted on the rear plate and including a display and a plurality of switches so that a user of the lighting fixture may input control commands to the lighting fixture to control the illumination of the at least one light emitting device.

8. A lighting fixture as defined by claim 5, wherein the rear plate is formed with a plurality of open slots situated about the periphery thereof, the open slots being spaced apart from each other, each open slot being aligned with a corresponding channel formed in a side wall of the main body of the housing.

9. A lighting fixture as defined by claim 4, wherein the front plate assembly includes a front plate, the front plate being generally planar in shape.

10. A lighting fixture as defined by claim 9, wherein each elongated channel formed in the side walls of the main body of the housing includes a first axial end situated near the front side of the main body of the housing and a second axial end situated opposite the first axial end and near the rear side of the main body of the housing; and wherein the front plate includes portions thereof which extend outwardly to cover the first axial end of each elongated channel formed in the side walls of the main body of the housing, the portions acting as stops which are engagable by the interlock piece.

11. A lighting fixture as defined by claim 9, wherein the front plate includes a front surface, and wherein the front plate assembly further includes a pair of L-shaped brackets, the L-shaped brackets being situated on the front surface of the front plate and extending outwardly therefrom, the L-shaped brackets being spaced apart from each other to receive therebetween one of a lens and a diffuser.

12. A lighting fixture as defined by claim 11, wherein the front plate assembly further includes a mechanism for selectively holding the one of the lens and the diffuser in place between the pair of L-shaped brackets on the front surface of the front plate.

13. A lighting fixture as defined by claim 12, wherein the mechanism includes a retractable spring member mounted on the front plate, the spring member being selectively positionable in at least a first position in which the spring member extends outwardly from the front surface of the front plate a first distance, and a second position in which the spring member at least one of 1) does not extend outwardly from the front surface of the front plate, and 2) extends outwardly from the front surface of the front plate a second distance, the first distance being greater than the second distance.

14. A lighting fixture as defined by claim 12, wherein the mechanism includes a resilient, partially coiled spring having a hooked end, the hooked end of the spring being selectively positionable in at least a first position to retain the one of the lens and the diffuser in place on the front surface of the front plate, and a second position to allow the one of the lens and the diffuser to be removed from a position on the front surface of the front plate.

15. A lighting fixture as defined by claim 1, which further comprises:

a hanger assembly, the hanger assembly being mountable to the main body of the housing, the hanger assembly including at least one hanger block, the at least one hanger block being receivable in the elongated channel formed in one of the side walls of the main body and being selectively positionable along the axial length of the elongated channel.

16. A lighting fixture as defined by claim 1, which further comprises:

a hanger assembly, the hanger assembly being mountable to the main body of the housing, the hanger assembly including a hanger piece formed as a generally U-shaped member, the hanger piece including a central cross leg having opposite axial ends, and first and second opposite side legs extending at an angle from the opposite axial ends of the central cross leg, each of the first and second side legs having a free end, the hanger assembly further including first and second hanger blocks, the first hanger block being mounted to the free end of the first side leg, and the second hanger block being mounted to the free end of the second side leg, the first and second hanger blocks being receivable by elongated channels formed in respective side walls of the main body of the housing and being selectively positionable along the axial lengths of the elongated channels.

17. A lighting fixture, which comprises:

a housing, the housing including a main body having an overall polygonal shape and including a plurality of generally planar side walls, the main body defining an interior space, each side wall of the polygonally-shaped main body of the housing having an outer surface and an elongated channel formed in the outer surface; and an interlock piece, the interlock piece having an elongated member which is at least partially receivable by the elongated channel formed in each side wall of the main body of the housing to interconnect the lighting fixture with another, similarly-structured lighting fixture;

wherein the interlock piece includes a generally elongated member having a pair of laterally conjoined tubular members, the elongated member having a first axial end and a second axial end disposed opposite the first axial end, each tubular member having a first axial end situated in proximity to the first axial end of the elongated member, and a second axial end situated opposite the first axial end of the tubular member, the interlock piece further including a resilient cushioning piece situated at the first axial end of each tubular member, and a rotatable fastener mounted on the second axial end of the elongated member.

18. A lighting fixture as defined by claim 17, wherein each tubular member includes at least one projection extending radially outwardly therefrom along at least a portion of the longitudinal length thereof, the radially extending projection of each tubular member being receivable by the elongated channel formed in a respective side wall of the main body of the housing.

19. A lighting fixture as defined by claim 18, wherein the at least one projection includes first and second angled fins spaced apart from each other and extending radially outwardly from each tubular member, the first and second angled fins of one of the tubular members being receivable by the elongated channel formed in a respective side wall of the main body of the housing.

20. A lighting fixtures as defined by claim 17, wherein the rotatable fastener includes a main body and a pair of flanges extending outwardly from the main body of the fastener; wherein the main body of the housing includes a front side and a rear side situated axially opposite the front side; wherein each elongated channel formed in the side walls of the main body of the housing includes a first axial end situated near the front side of the main body of the housing and a second axial end situated opposite the first axial end and near the rear side of the main body of the housing; wherein the housing further includes a rear plate assembly mounted to the main body of the housing at the rear side thereof and a front plate assembly mounted to the main body of the housing at the front side thereof; wherein the rear plate assembly includes a rear plate, the rear plate being generally planar in shape; and wherein the front plate assembly includes a front plate, the front plate being generally planar in shape and having portions thereof which extend outwardly to cover the first axial end of each elongated channel formed in the side walls of the main body of the housing, the portions acting as stops which are engagable by the cushioning piece situated at the first axial end of one of the tubular members of the interlock piece, the rear plate of the rear plate assembly having an outer surface, the rear plate assembly further including a plurality of U-shaped catches extending outwardly from the outer surface of the rear plate, the catches being spaced apart from each other and situated in alignment with corresponding channels formed in the side walls of the main body of the housing, each U-shaped catch at least partially defining a slot for receiving one of the protruding flanges of the fastener of the interlock piece to help hold the interlock piece in place at least partially within an elongated channel of a respective side wall of the main body of the housing in which the interlock piece is at least partially received.

21. A modular arrangement of a plurality of lighting fixtures, adjacent lighting fixtures being joined together, each lighting fixture comprising:

a housing, the housing including a main body having an overall polygonal shape and including a plurality of generally planar side walls, the main body defining an interior space, each side wall of the polygonally-shaped main body of the housing having an outer surface and an elongated channel formed in the outer surface; and an interlock piece, the interlock piece having an elongated member which is at least partially receivable by the elongated channel formed in each side wall of the main body of the housing to interconnect the lighting fixture with another, similarly-structured lighting fixture of the modular arrangement;

wherein the elongated channel formed in the outer surface of each side wall of the main body of the housing includes a dovetail transverse cross-sectional shape, each side wall of the main body having a recessed portion formed in the outer surface thereof and two laterally opposite portions which face each other and partly overhang the recessed portion, whereby the recessed portion of each side wall and the two laterally opposite portions of the each side wall at least partially define the elongated channel formed in the outer surface of each side wall of the main body.

22. A modular arrangement of a plurality of lighting fixtures, adjacent lighting fixtures being joined together, each lighting fixture comprising:

a housing, the housing including a main body having an overall polygonal shape and including a plurality of generally planar side walls, the main body defining an interior space, each side wall of the polygonally-shaped main body of the housing having an outer surface and an elongated channel formed in the outer surface; and an interlock piece, the interlock piece having an elongated member which is at least partially receivable by the elongated channel formed in each side wall of the main body of the housing to interconnect the lighting fixture with another, similarly-structured lighting fixture of the modular arrangement;

wherein the interlock piece includes a generally elongated member having a pair of laterally conjoined tubular members, the elongated member having a first axial end and a second axial end disposed opposite the first axial end, each tubular member having a first axial end situated in proximity to the first axial end of the elongated member, and a second axial end situated opposite the first axial end of the tubular member, the interlock piece further including a resilient cushioning piece situated at the first axial end of each tubular member, and a rotatable fastener mounted on the second axial end of the elongated member.

* * * * *